US010449789B2

(12) United States Patent
Nonaka et al.

(10) Patent No.: US 10,449,789 B2
(45) Date of Patent: Oct. 22, 2019

(54) INKJET PRINTER AND INKJET PRINTER INCLUDING CUTTING HEAD

(71) Applicant: Roland DG Corporation, Hamamatsu-shi, Shizuoka (JP)

(72) Inventors: Ryosuke Nonaka, Hamamatsu (JP); Yusuke Takano, Hamamatsu (JP)

(73) Assignee: ROLAND DG CORPORATION, Shizouka (JP)

( * ) Notice: Subject to any disclaimer, the term of this patent is extended or adjusted under 35 U.S.C. 154(b) by 0 days.

(21) Appl. No.: 16/162,748

(22) Filed: Oct. 17, 2018

(65) Prior Publication Data

US 2019/0111712 A1 Apr. 18, 2019

(30) Foreign Application Priority Data

Oct. 18, 2017 (JP) ..... 2017-202221
Mar. 30, 2018 (JP) ..... 2018-068004

(51) Int. Cl.

| | |
|---|---|
| ***B41J 11/70*** | (2006.01) |
| ***B41J 13/02*** | (2006.01) |
| ***B65H 5/06*** | (2006.01) |
| ***B41J 2/135*** | (2006.01) |
| ***B41J 11/00*** | (2006.01) |

(Continued)

(52) U.S. Cl.

CPC ..... *B41J 11/706* (2013.01); *B41J 2/135* (2013.01); *B41J 11/005* (2013.01); *B41J 13/025* (2013.01); *B41J 13/036* (2013.01); *B41J 29/02* (2013.01); *B41J 29/38* (2013.01); *B65H 5/062* (2013.01); *B41J 13/076* (2013.01); *B41J 13/14* (2013.01); *B65H 2404/1321* (2013.01); *B65H 2404/144* (2013.01); *B65H 2404/1431* (2013.01)

(58) Field of Classification Search

CPC ..... B41J 11/706; B41J 29/38; B41J 11/005; B41J 2/135; B41J 13/036; B41J 13/14; B41J 13/076

See application file for complete search history.

(56) References Cited

U.S. PATENT DOCUMENTS 4,205,770 A * 6/1980 Wojdyla ..... B41J 11/48 101/228
4,537,521 A 8/1985 Rekewitz et al.
(Continued)

FOREIGN PATENT DOCUMENTS

CA 2 961 643 A1 3/2011
CN 101544107 A 9/2009
(Continued)

OTHER PUBLICATIONS

Official Communication issued in Japanese Patent Application No. 2018-068004, dated Jun. 5, 2018.

*Primary Examiner* — Henok D Legesse
(74) *Attorney, Agent, or Firm* — Keating & Bennett, LLP

(57) ABSTRACT

A printer includes a first holding shaft holding side pinch rollers and at least one center pinch roller, grit rollers moving a recording medium while holding the recording medium together with the side pinch rollers and together with the center pinch roller, and a rotator rotating the first holding shaft to cause the side pinch rollers and the center pinch roller to approach, or to be separated from, the grit rollers. The center pinch roller is movable in a direction to be separated from the recording medium, independently from the side pinch rollers.

18 Claims, 13 Drawing Sheets

(51) Int. Cl.

| | |
|---|---|
| ***B41J 13/036*** | (2006.01) |
| ***B41J 29/38*** | (2006.01) |
| ***B41J 29/02*** | (2006.01) |
| *B41J 13/076* | (2006.01) |
| *B41J 13/14* | (2006.01) |

(56) References Cited

U.S. PATENT DOCUMENTS

| | | | |
|---|---|---|---|
| 7,140,726 | B2 | 11/2006 | Silverbrook |
| 2009/0244127 | A1 | 10/2009 | Kawai et al. |
| 2012/0228089 | A1 | 9/2012 | Tanaka et al. |
| 2014/0035988 | A1 | 2/2014 | Naruse |
| 2015/0009258 | A1 | 1/2015 | Moriyama |

FOREIGN PATENT DOCUMENTS

| | | | | | |
|---|---|---|---|---|---|
| CN | 101544107 | B | | 3/2011 | |
| CN | 104275947 | A | | 1/2015 | |
| CN | 104275947 | B | | 1/2017 | |
| EP | 1 974 938 | A1 | | 10/2008 | |
| EP | 2 338 688 | A1 | | 6/2011 | |
| JP | 2000-317890 | A | | 11/2000 | |
| JP | 2001-225297 | A | | 8/2001 | |
| JP | 2006-095822 | A | | 4/2006 | |
| JP | 2006095822 | | * | 4/2006 | ..... B41J 11/66 |
| JP | 4855510 | B2 | | 1/2012 | |
| JP | 2014-028457 | A | | 2/2014 | |
| JP | 2014-108883 | A | | 6/2014 | |
| JP | 2014108883 | | * | 6/2014 | ..... B26D 5/00 |

* cited by examiner

INKJET PRINTER AND INKJET PRINTER INCLUDING CUTTING HEAD

CROSS REFERENCE TO RELATED APPLICATIONS

This application claims the benefit of priority to Japanese Patent Application No. 2017-202221 filed on Oct. 18, 2017 and Japanese Patent Application No. 2018-068004 filed on Mar. 30, 2018. The entire contents of these applications are hereby incorporated herein by reference.

BACKGROUND OF THE INVENTION

1. Field of the Invention

The present invention relates to an inkjet printer, and also an inkjet printer including a cutting head.

2. Description of the Related Art

Conventionally, an inkjet printer including a cutting head performs printing on a recording medium, for example, a recording paper sheet or a resin sheet, and then cuts off an area around an image printed on the recording medium. Japanese Patent No. 4855510, for example, discloses such an inkjet printer including a cutting head.

As shown in Japanese Patent No. 4855510, this type of inkjet printer moves, while holding, the recording medium between pinch rollers pressing the recording medium and driving rollers located below the pinch rollers at the time of printing and cutting. The pinch rollers include a pair of side pinch rollers pressing both of two ends of the recording medium and at least one center pinch roller provided between the pair of side pinch rollers. For printing, the side pinch rollers and the driving rollers, and the center pinch roller and the driving roller, hold the recording medium so as not to allow the recording medium to float from a table on which the recording medium is placed. In this manner, a defect in that the image quality is varied region by region in the entirety of the recording medium is suppressed.

For cutting the recording medium having an image printed on a surface thereof, the recording medium is returned to a position where the printing is started (hereinafter, such a position will be referred to as a "printing start position"). If the center pinch roller and the driving roller are holding the recording medium at this time, the center pinch roller runs on the printed surface of the recording medium. This makes the printed image defective. In order to avoid this, when the recording medium is to be returned to the printing start position, the center pinch roller is lifted so as to avoid the recording medium from being held between the center pinch roller and the driving roller. In addition, for cutting the recording medium, the recording medium needs to move in a reciprocating manner. Therefore, in order to avoid the recording medium from positionally shifted, the center pinch roller is lifted so as to avoid the recording medium from being held between the center pinch roller and the driving roller. According to Japanese Patent No. 4855510, the side pinch rollers and the center pinch roller are attached to a holding shaft, and the side pinch rollers are attached to positions lower than that of the center pinch roller to adjust the degree at which the recording medium is held during the printing and the cutting. The technology described in Japanese Patent No. 4855510 sufficiently adjusts the positions of the pinch rollers at the time of printing and cutting, but a structure capable of adjusting the positions of the pinch rollers more certainly has been desired.

SUMMARY OF THE INVENTION

Preferred embodiments of the present invention provide inkjet printers holding a recording medium appropriately between a pinch roller and a driving roller in accordance with the content of an operation performed on the recording medium.

An inkjet printer according to a preferred embodiment of the present invention includes a table on which a recording medium is to be placed; an inkjet head that is movable in a first direction and performs printing on the recording medium placed on the table; and a moving mechanism that moves the recording medium placed on the table in a second direction crossing the first direction. The moving mechanism includes a pair of side pinch rollers that are located above the table, are rotatable, and press both of two ends of the recording medium in the first direction; at least one center pinch roller that is provided between the pair of side pinch rollers, is rotatable, and presses the recording medium; a first holding shaft that extends in the first direction and holds the pair of side pinch rollers and the at least one center pinch roller; a plurality of driving rollers that are arrayed in the first direction, are located below the pair of side pinch rollers and the at least one center pinch roller, and move the recording medium in the second direction while holding the recording medium together with the pair of side pinch rollers and together with the at least one center pinch roller; and a first rotator that rotates the first holding shaft so as to cause the pair of side pinch rollers and the at least one center pinch roller to approach, or to be separated from, the plurality of driving rollers. The at least one center pinch roller is movable, from a state in which the pair of side pinch rollers and the at least one center pinch roller hold the recording medium together with the plurality of driving rollers, in such a direction as to be separated from the recording medium, independently from the pair of side pinch rollers, in a state in which the first holding shaft is not rotating.

In an inkjet printer according to a preferred embodiment of the present invention, the first rotator rotates the first holding shaft to cause the side pinch rollers and the center pinch roller to approach the grit rollers. With such a structure, the recording medium is held between the side pinch rollers and the grit rollers and between the center pinch roller and the grit rollers. In this manner, at the time of the printing, the defect that the image quality is varied region by region in the entirety of the recording medium is reduced or prevented. In addition, the center pinch roller is movable, from the state in which the side pinch rollers and the center pinch roller hold the recording medium together with the grit rollers, in such a direction as to be separated away from the recording medium, independently from the side pinch rollers. As a result, a state is realized where the side pinch rollers and the grit rollers hold the recording medium whereas the center pinch roller and the grit rollers do not hold the recording medium 5. Therefore, when the recording medium is to be subjected to printing again after being returned to the printing start position, the recording medium is prevented from being positionally shifted.

Preferred embodiments of the present invention provide inkjet printers holding a recording medium appropriately between a pinch roller and a driving roller in accordance with the content of operation performed on the recording medium.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
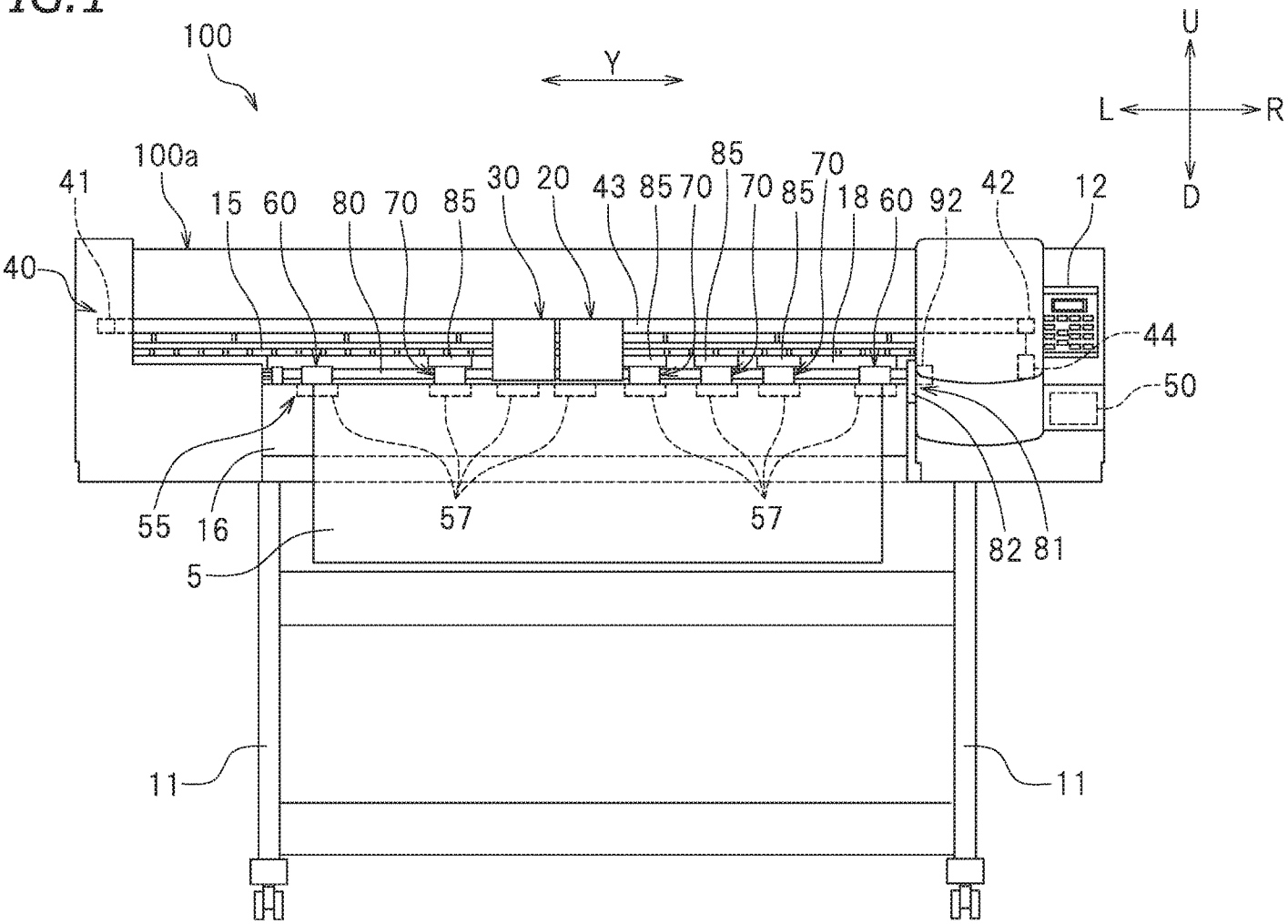
FIG. 1 is a front view of a printer according to a preferred embodiment of the present invention.

Hereinafter, preferred embodiments of inkjet printers including a cutting head (hereinafter, referred to as a "printer 100") according to the present invention will be described with reference to the drawings. The preferred embodiments described herein are not intended to specifically limit the present invention, needless to say. Components and portions that have the same functions will bear the same reference signs, and overlapping descriptions will be omitted or simplified. As shown in FIG. 1, the printer 100 according to a preferred embodiment is a printer/cutter capable of performing printing on, and cutting, a recording medium 5.

In the following description, the terms "left", "right", "up" and "down" respectively refer to left, right, up and down as seen from an operator who faces a front surface of the printer 100. A direction separated away from the printer 100 toward the operator is referred to as "forward", and a direction approaching the printer 100 away from the operator is referred to as "rearward". In the drawings, letters F, Rr, L, R, U and D respectively represent front, rear, left, right, up and down. In the drawings, letter Y represents a main scanning direction. In this preferred embodiment, the main scanning direction Y is a left-right direction. The main scanning direction Y is an example of first direction. In the drawings, letter X represents a sub scanning direction. The sub scanning direction X is a direction crossing the main scanning direction Y (e.g., direction crossing the main scanning direction Y perpendicularly as seen in a plan view). In this preferred embodiment, the sub scanning direction X is a front-rear direction. The sub scanning direction X is an example of second direction. The above-described directions are merely defined for the sake of convenience, and are not to be construed in a limited manner.

The recording medium 5 is, for example, a recording paper sheet. The recording medium 5 is not limited to a recording paper sheet. The recording medium 5 includes, for example, a sheet formed of a resin material such as PVC, polyester or the like, a sealing member including a mount paper board and a release paper sheet that is stacked on the mount paper board and is coated with a pressure-sensitive adhesive, a metal plate formed of aluminum, iron or the like, a glass plate, a wooden plate and the like. In this specification, the terms "cut" and "cutting" refer to cutting the recording medium 5 in the entirety of the thickness direction thereof (e.g., cutting both of the mount paper board and the release paper sheet of the sealing member) and cutting the recording medium 5 in a portion of the thickness direction thereof (e.g., cutting only the releasing paper sheet without cutting the mount paper board).

As shown in FIG. 1, the printer 100 includes a printer main body 100*a*, legs 11, an operation panel 12, a platen 16 on which the recording medium 5 is to be placed, an inkjet head 20, a cutting head 30, a head moving mechanism 31, a medium moving mechanism 55, and a controller 50. The printer main body 100*a* includes a casing extending in the main scanning direction Y. The legs 11 support the printer main body 100*a*, and are provided on a bottom surface of the printer main body 100*a*. The operation panel 12 is provided on, for example, a front surface of a right portion of the printer main body 100*a*. There is no specific limitation on the position of the operation panel 12. The operation panel 12, for example, allows the operator to make an operation regarding the printing or the cutting. Although not shown, the operation panel 12 includes a display that displays information on the printing, for example, the resolution, the darkness of the ink and the like, the status of the printer 100 during the printing or the cutting, and the like, and also includes an input portion into which information on the printing or the cutting is to be input.

The platen 16 supports the recording medium 5 while the printing is being performed on the recording medium 5 and while the recording medium 5 is being cut. The recording medium 5 is placed on the platen 16. The platen 16 is an example of table. The printing on the recording medium 5 and the cutting of the recording medium 5 are performed on the platen 16. The platen 16 extends in the main scanning direction Y. A guide rail 15 extending in the main scanning direction Y is located above the platen 16.

Figure 2A:
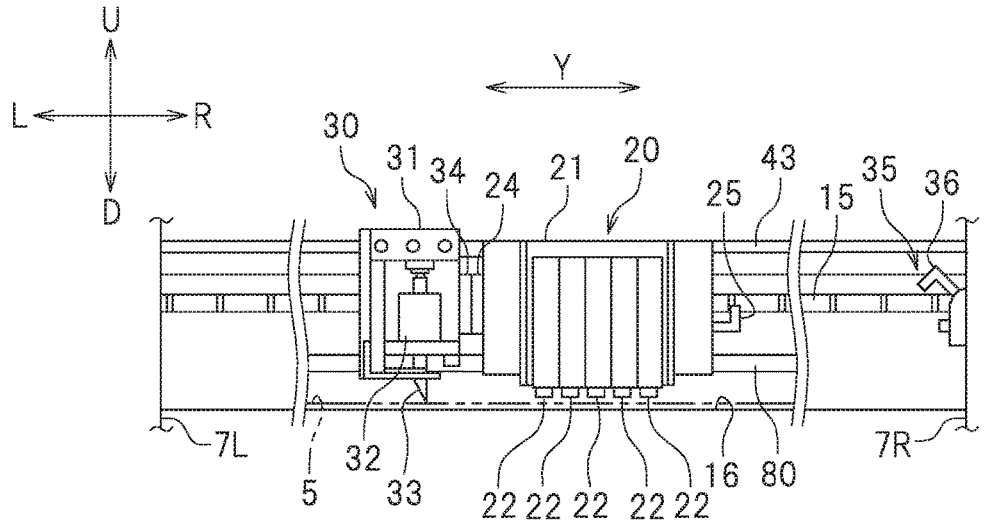
FIG. 2A is a front view of an inkjet head and a cutting head.

The inkjet head 20 performs the printing on the recording medium 5 placed on the platen 16. The inkjet head 20 is movable in the main scanning direction Y. As shown in FIG. 2A, the inkjet head 20 includes a carriage 21 and a plurality of recording heads 22 each including a plurality of nozzles (not shown) discharging ink. In this example, five recording heads 22 are supported by the carriage 21. The five recording heads 22 respectively discharge different colors of ink, for example, yellow ink, magenta ink, cyan ink, black ink and white ink. The number of the recording heads 22 is not limited to five. There is no specific limitation on the colors of the ink to be discharged by the recording heads 22. The carriage 21 is supported by the guide rail 15. The carriage 21 is engaged with the guide rail 15 so as to be movable in the main scanning direction Y.

The cutting head 30 cuts the recording medium 5 placed on the platen 16. The cutting head 30 is movable in the main scanning direction Y. As shown in FIG. 2A, the cutting head 30 includes a carriage 31, a solenoid 32, and a cutter 33. The cutter 33 is attached to the carriage 31 while the solenoid 32 is located between the cutter 33 and the carriage 31. The solenoid 32 is controlled by the controller 50 (see FIG. 1). When the solenoid 32 is turned on or off, the cutter 33 moves in an up-down direction to contact the recording medium 5 or to be separated away from the recording medium 5. The carriage 31 is supported by the guide rail 15. The carriage 31 is engaged with the guide rail 15 so as to be movable in the main scanning direction Y.

The head moving mechanism 40 moves the carriage 21 of the inkjet head 20 and the carriage 31 of the cutting head 30 in the main scanning direction Y with respect to the recording medium 5 placed on the platen 16. The head moving mechanism 40 moves the carriage 21 and the carriage 31 in the main scanning direction Y. There is no specific limitation on the structure of the head moving mechanism 40. As shown in FIG. 1, the head moving mechanism 40 includes a pulley 41, a pulley 42, an endless belt 43, and a carriage motor 44. The pulley 41 is provided at a left end of the guide rail 15. The pulley 42 is provided at a right end of the guide rail 15. The belt 43 is wound around the pulley 41 and the pulley 42. The belt 43 is secured to a rear top portion of the carriage 31 (see FIG. 2). The carriage motor 44 is connected with the right pulley 42. Alternatively, the carriage motor 44 may be connected with the left pulley 41. In this example, the carriage motor 44 is driven to rotate the pulley 42, and as a result, the belt 43 runs between the pulley 41 and the pulley 42. This causes the carriage 31 to move in the main scanning direction Y. The carriage motor 44 is controlled by the controller 50.

As shown in FIG. 2A, a coupling member 24 made of a magnet is provided at a left end of the carriage 21. A coupling member 34 made of a magnet is secured to a right end of the carriage 31. The coupling member 24 is detachably coupled with the coupling member 34 of the cutting head 30. In this preferred embodiment, the coupling member 24 and the coupling member 34 are coupled with each other by use of a magnetic force. The coupling member 24 and the coupling member 34 are not limited to being coupled with each other by use of a magnetic force, and may have any other structure. For example, the coupling member 24 and the coupling member 34 may be engageable members. An L-shaped bracket 25 is provided at a right end of the carriage 21.

As shown in FIG. 2A, a left side frame 7L and a right side frame 7R are respectively located to the left and to the right of the platen 16. A main body frame 19 (see FIG. 13) is supported by the left side frame 7L and the right side frame 7R. The guide rail 15 is attached to the main body frame 19. A lock device 35 locking the inkjet head 20 at a wait position is provided on the right side frame 7R. The lock device 35 includes a bracket 36, which may be hooked on the bracket 25, and a locking solenoid 37 (see FIG. 3) moving the bracket 36 between a lock position (see FIG. 2B) and a non-lock position (see FIG. 2A). The locking solenoid 37 is controlled by the controller 50.

Figure 2B:
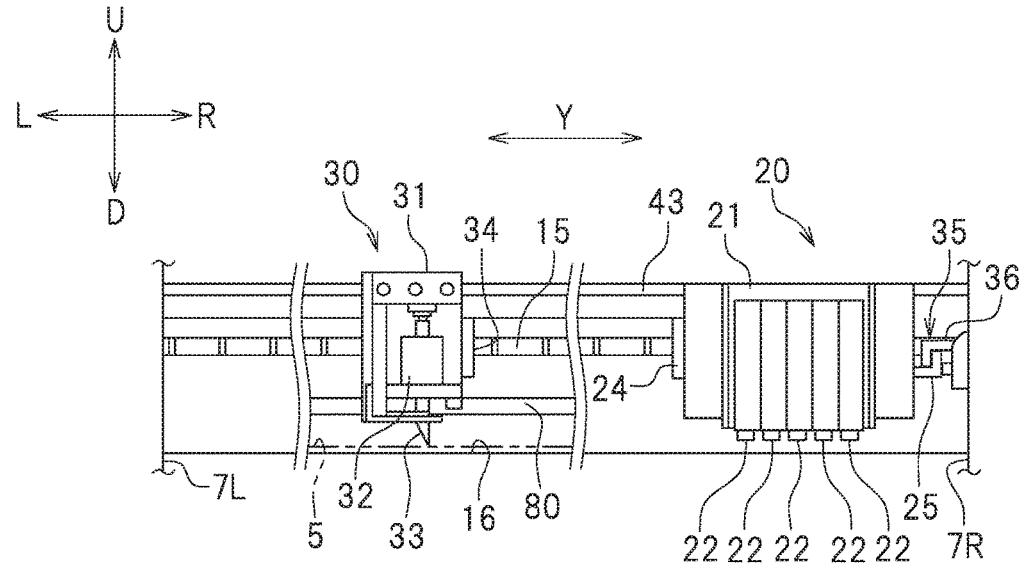
FIG. 2B is a front view of the inkjet head and the cutting head.

As shown in FIG. 2A, when the inkjet head 20 is to perform the printing, the bracket 36 is set at the non-lock position. When the carriage 31 of the cutting head 30 moves rightward and thus the coupling member 34 and the coupling member 24 contact each other, the carriage 31 and the carriage 21 are coupled with each other. As a result, the inkjet head 20 is movable in the left-right direction together with the cutting head 30. By contrast, when the cutting head 30 is to cut the recording medium 5, as shown in FIG. 2B, the inkjet head 20 is set at the wait position, and the bracket 36 of the lock device 35 is set at the lock position. This inhibits the inkjet head 20 from moving. When the carriage 31 moves leftward, the coupling member 34 and the coupling member 24 are separated from each other, and thus the carriage 31 and the carriage 21 are disengaged from each other. As a result, the cutting head 30 is made movable in the left-right direction while the inkjet head 20 waits at the wait position.

The medium moving mechanism 55 moves the recording medium 5 placed on the platen 16 in the sub scanning direction X with respect to the inkjet head 20 and the cutting head 30. The medium moving mechanism 55 moves the recording medium 5 placed on the platen 16 in the sub scanning direction X. The medium moving mechanism 55 is an example of moving mechanism. As shown in FIG. 4, the medium moving mechanism 55 includes grit rollers 57, a feed motor 58 (see FIG. 3), side pinch roller units 60, center pinch roller units 70, a first holding shaft 80, a rotator 81, and a center pinch roller lifting mechanism 85. The rotator 81 is an example of first rotator.

Figure 3:
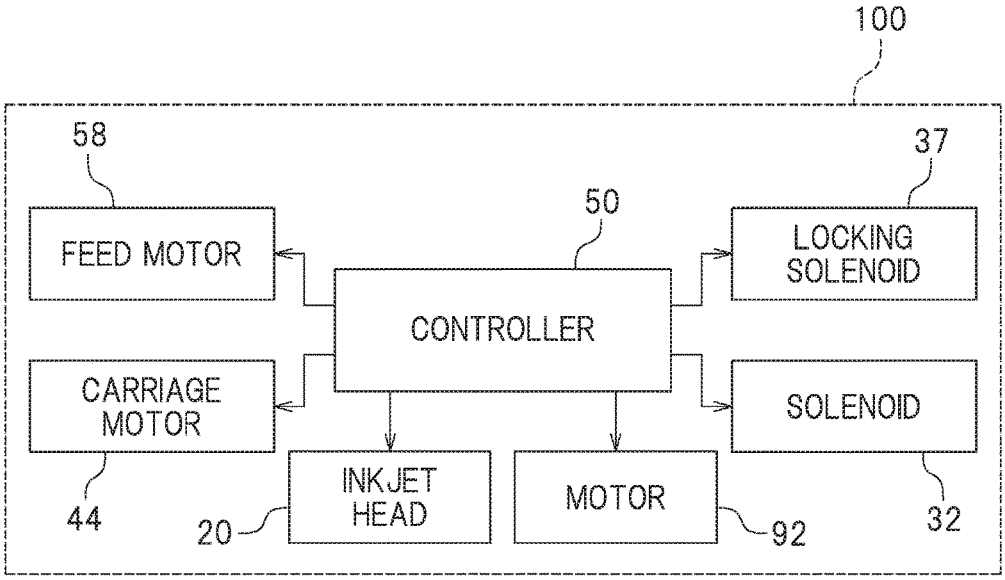
FIG. 3 is a block diagram of a control system of a printer according to a preferred embodiment of the present invention.
Figure 4:
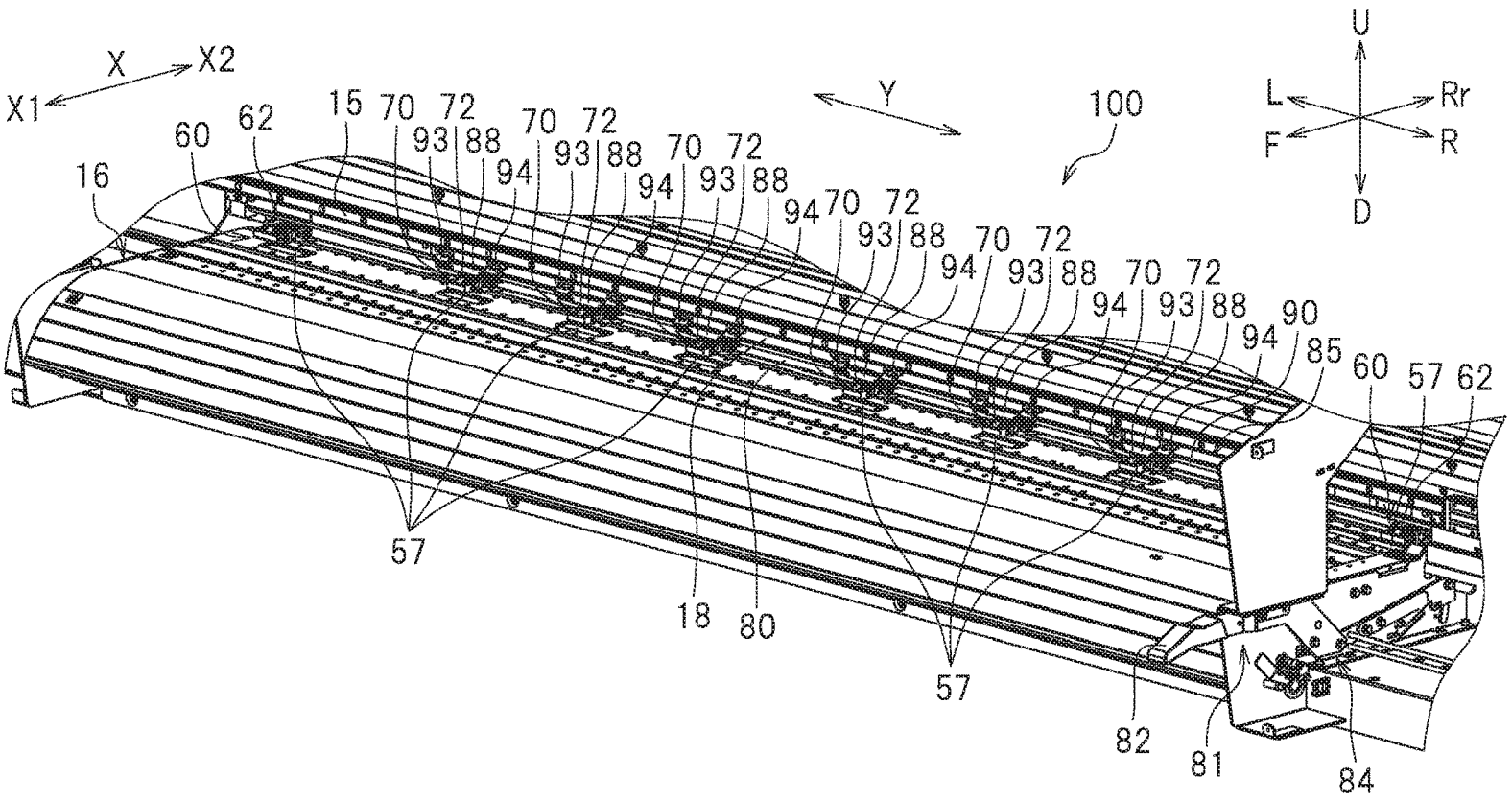
FIG. 4 is a perspective view of a portion of a printer according to a preferred embodiment of the present invention.
Figure 5:
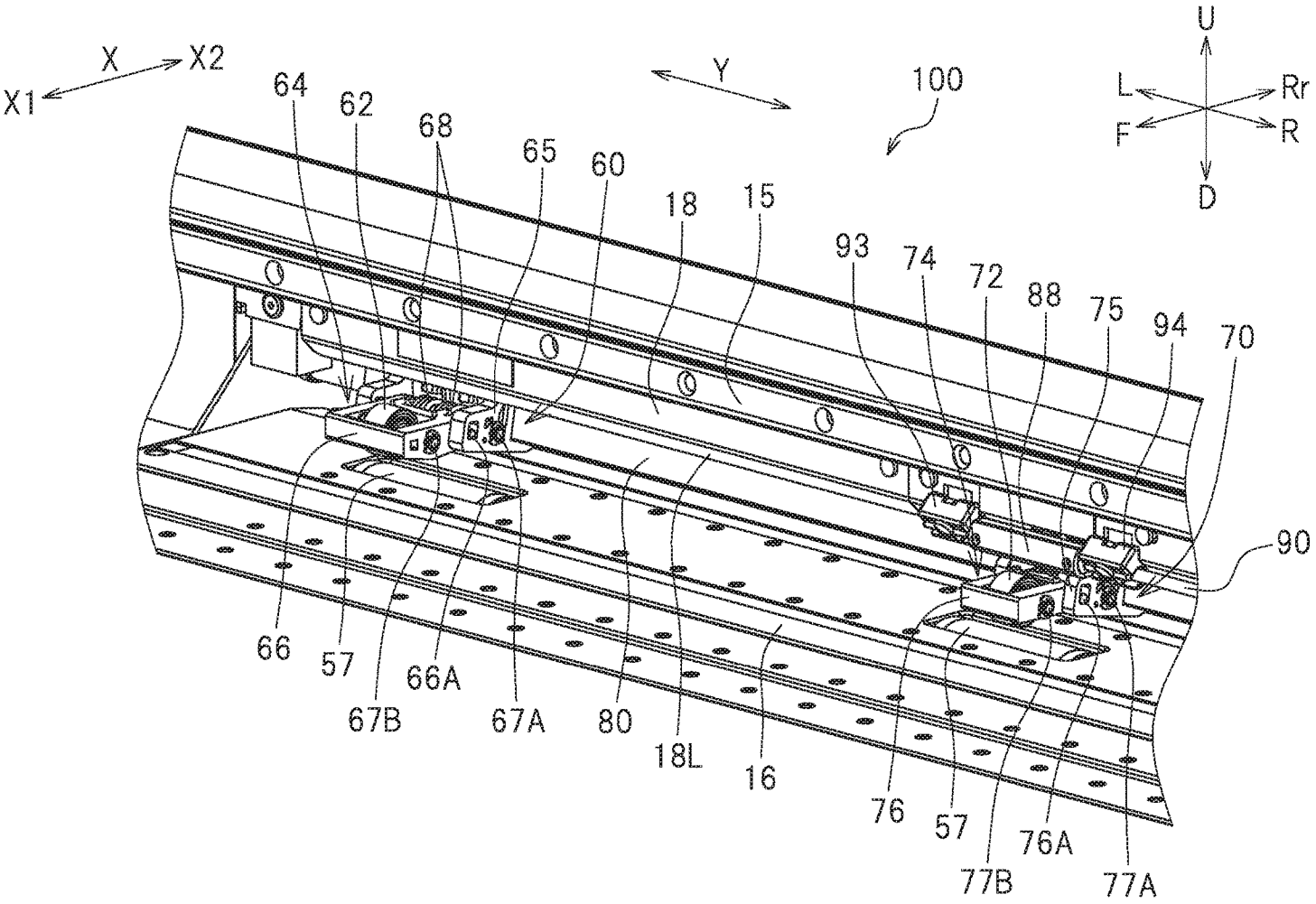
FIG. 5 is a perspective view showing a structure of a platen and the vicinity thereof according to a preferred embodiment of the present invention.

As shown in FIG. 4, the grit rollers 57 are provided in the platen 16. The grit rollers 57 are each provided in the platen 16 such that a top portion thereof is exposed. In this preferred embodiment, the printer 100 includes eight grit rollers 57, for example. The number of the grit rollers 57 is not limited to eight. The grit rollers 57 are each an example of driving roller. The grit rollers 57 are arrayed in the main scanning direction Y. As shown in FIG. 5, some of the grit rollers 57 are located below side pinch rollers 62 described below. Such grit rollers 57 located below the side pinch rollers 62 hold the recording medium 5 such that the recording medium 5 is between such grit rollers 57 and the side pinch rollers 62. The other grit rollers 57 are located below center pinch rollers 72 described below. Such grit rollers 57 located below the center pinch rollers 72 hold the recording medium 5 such that the recording medium 5 is between such grit rollers 57 and the center pinch rollers 72. The feed motor 58 (see FIG. 3) is connected with the grit rollers 57. The feed motor 58 is controlled by the controller 50. When the feed motor 58 is driven to rotate the grit rollers 57 in the state in which the recording medium 5 is held between the grit rollers 57 and the side pinch rollers 62 and between the grit rollers 57 and the center pinch rollers 72, the recording medium 5 is transferred in the sub scanning direction X. In this preferred embodiment, the recording medium 5 is transferred from an upstream position toward a downstream position, namely, in a sub scanning direction X1, in the state of being held between the grit rollers 57 and the side pinch rollers 62 and between the grit rollers 57 and the center pinch rollers 72. By contrast, the recording medium 5 is transferred from the downstream position toward the upstream position, namely, in a sub scanning direction X2, in the state of being held between the grit rollers 57 and the side pinch rollers 62.

Figure 6:
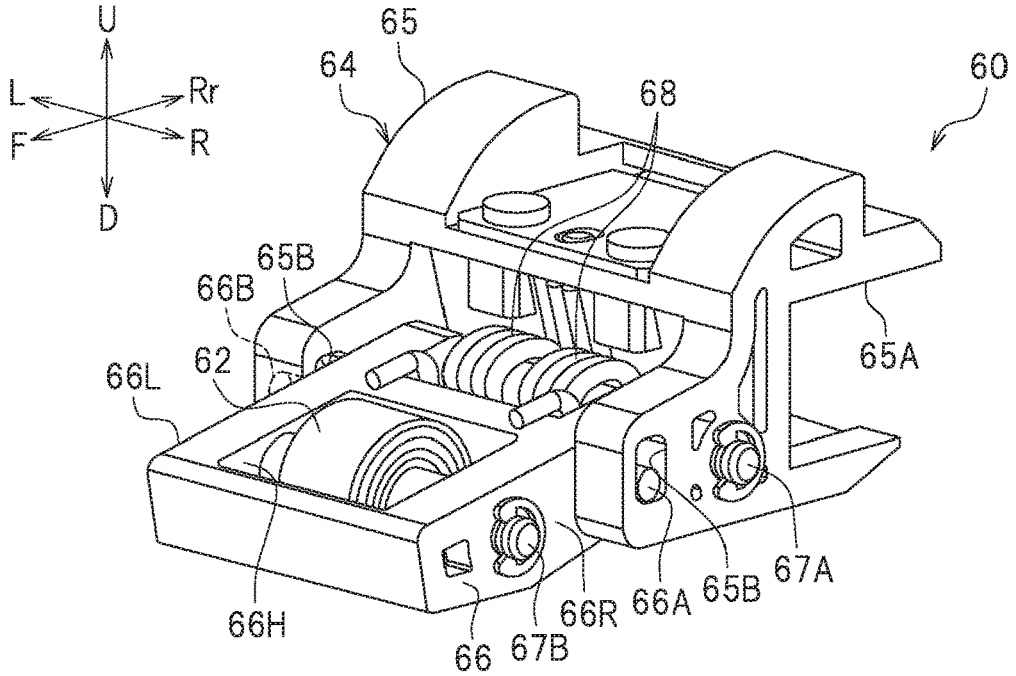
FIG. 6 is a perspective view of a side pinch roller unit according to a preferred embodiment of the present invention.

As shown in FIG. 6, the side pinch roller units 60 each include the side pinch roller 62 and a first holding member 64. The side pinch roller units 60 are located above the platen 16 (see FIG. 1). In this preferred embodiment, the printer 100 includes two side pinch roller units 60. The side pinch roller units 60 are arrayed in the main scanning direction Y. The side pinch roller 62 of each side pinch roller unit 60 presses a corresponding end of the recording medium 5 from above. As shown in FIG. 5, the side pinch roller 62 is located above the corresponding grit roller 57 so as to face the grit roller 57 in the up-down direction. The side pinch rollers 62 are made of, for example, rubber. The side pinch rollers 62 are pivotable about the first holding shaft 80. As used herein, the term "pivotable" includes both a "pivotable" and a "rotatable" structural relationship. The side pinch rollers 62 are pivotable to contact with, or to be separated from, the corresponding grit rollers 57. The first holding member 64 of each side pinch roller unit 60 supports the side pinch roller 62 such that the side pinch roller 62 is rotatable. The first holding member 64 supports the side pinch roller 62 such that the side pinch roller 62 is movable in the up-down direction.

As shown in FIG. 6, the first holding member 64 includes a main body 65, an arm 66, a first shaft 67A, a second shaft 67B, and twisted coil springs 68. The main body 65 includes a recessed portion 65A, which is generally U-shaped as seen in a side view. A first holding shaft 80 (see FIG. 4) described below is fit into the recessed portion 65A. The main body 65 holds the first holding shaft 80. Namely, the first holding member 64 is held by the first holding shaft 80. The main body 65 includes the first shaft 67A supporting the arm 66 such that the arm 66 is pivotable. The first shaft 67A is rotatably supported by the main body 65. The main body 65 includes openings 65B extending in the up-down direction.

As shown in FIG. 6, a first protrusion 66A protruding rightward is provided on a right side surface 66R of the arm 66. The first protrusion 66A is inserted into one of the openings 65B. A second protrusion 66B protruding leftward is provided on a left side surface 66L of the arm 66. The second protrusion 66B is inserted into the other opening 65B. The first protrusion 66A and the second protrusion 66B are movable in the up-down direction in the openings 65B. Therefore, the side pinch roller 62 is movable in the up-down direction in accordance with the thickness of the recording medium 5. The arm 66 includes an opening 66H, in which the side pinch roller 62 is accommodated. The second shaft 67B, supporting the side pinch roller 62 such that the side pinch roller 62 is rotatable, is provided in the arm 66 so as to extend through the opening 66H.

As shown in FIG. 6, the twisted coil springs 68 are wound around the first shaft 67A. The twisted coil springs 68 are locked on the arm 66. The twisted coil springs 68 urge the arm 66 downward. In this preferred embodiment, there are two twisted coil springs 68, for example. The number of the twisted coil springs 68 is not limited to two.

Figure 7:
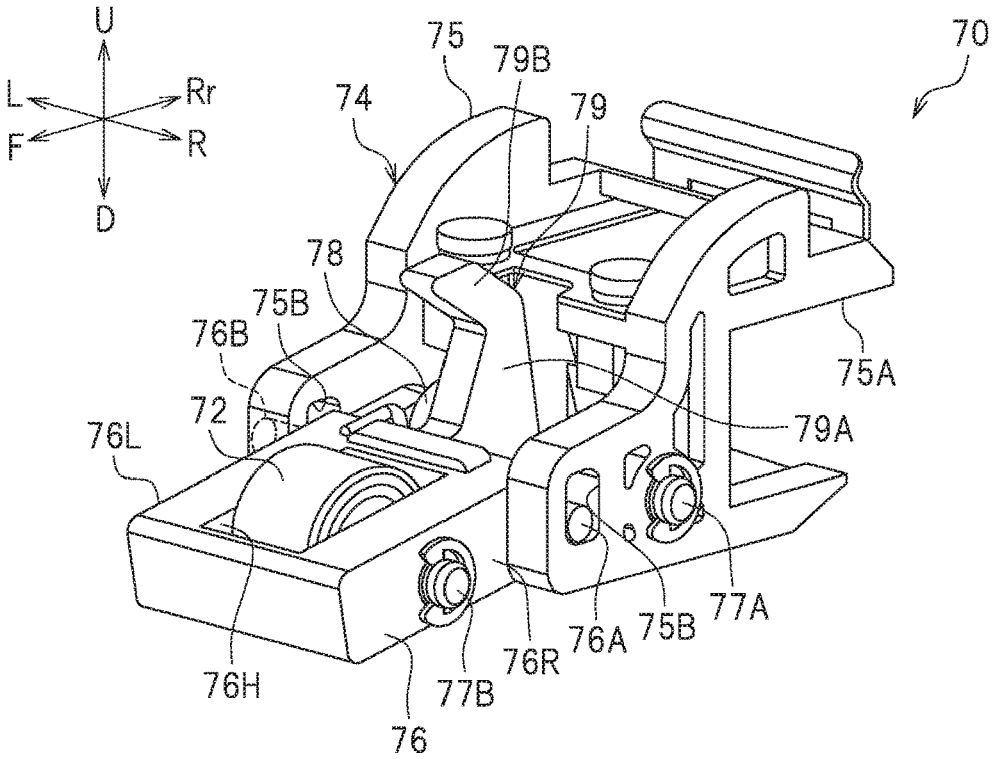
FIG. 7 is a perspective view of a center pinch roller unit according to a preferred embodiment of the present invention.

As shown in FIG. 7, the center pinch roller units 70 each include the center pinch roller 72 and a second holding member 74. The second holding member 74 is an example of holding member. The center pinch roller units 70 are located above the platen 16 (see FIG. 1). The center pinch roller units 70 are provided between the pair of side pinch roller units 60. In this preferred embodiment, the printer 100 includes six center pinch roller units 70, for example. The number of the center pinch roller units 70 is not limited to six. The center pinch roller units 70 are arrayed in the main scanning direction Y. The center pinch rollers 72 each press the recording medium 5 from above. As shown in FIG. 5, the center pinch roller 72 of each center pinch roller unit 70 is located above the corresponding grit roller 57 so as to face the grit roller 57 in the up-down direction. The center pinch rollers 72 are made of, for example, rubber. The center pinch rollers 72 are pivotable about the first holding shaft 80. The center pinch rollers 72 are pivotable to contact with, or to be separated from, the corresponding grit rollers 57. The second holding member 74 of each center pinch roller unit 70 supports the center pinch roller 72 such that the center pinch roller 72 is rotatable. The second holding member 74 supports the center pinch roller 72 such that the center pinch roller 72 is movable in the up-down direction. As described below, the center pinch rollers 72 are movable, from the state in which the side pinch rollers 62 and the center pinch rollers 72 hold the recording medium 5 together with the grit rollers 57, in such a direction as to be separated away from the grit rollers 57 (i.e., from the recording medium 5), independently from the side pinch rollers 62, in the state in which the first holding shaft 80 is not rotating.

Figure 13:
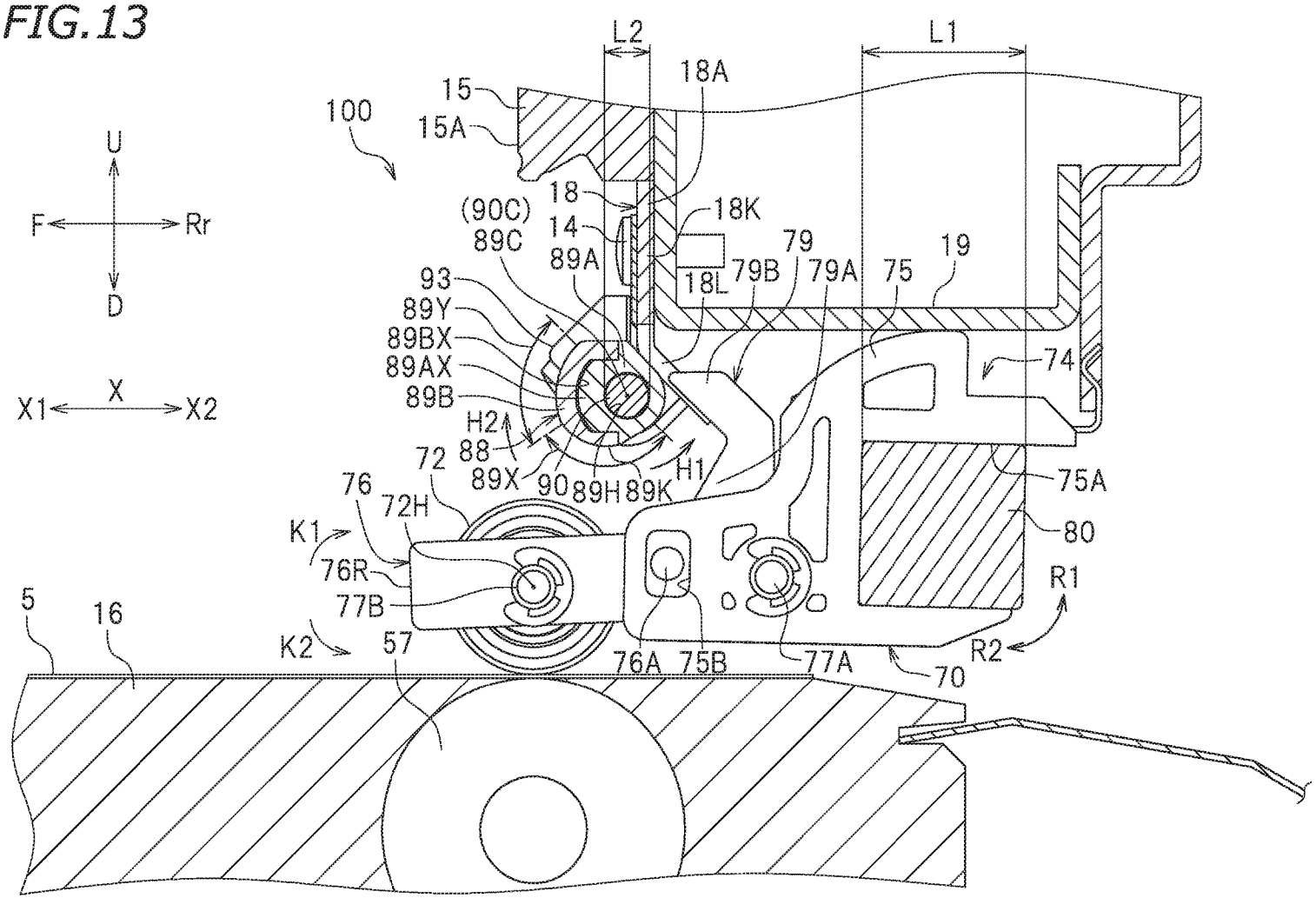
FIG. 13 is a partially cut cross-sectional view showing a structure of the center pinch roller unit and the vicinity thereof according to a preferred embodiment of the present invention.

As shown in FIG. 7, the second holding member 74 includes a main body 75, an arm 76, a first shaft 77A, a second shaft 77B, and a twisted coil spring 78. As shown in FIG. 13, the main body 75 includes a recessed portion 75A, which is generally U-shaped as seen in a side view. The first holding shaft 80 (see FIG. 4) described below is fit into the recessed portion 75A. The main body 75 holds the first holding shaft 80. Namely, the second holding member 74 is held by the first holding shaft 80. The main body 75 includes the first shaft 77A supporting the arm 76 such that the arm 76 is pivotable. The first shaft 77A is rotatably supported by the main body 75. The first shaft 77A is an example of first rotation shaft. The main body 75 includes openings 75B extending in the up-down direction.

As shown in FIG. 7, a first protrusion 76A protruding rightward is provided on a right side surface 76R of the arm 76. The first protrusion 76A is inserted into one of the openings 75B. A second protrusion 76B protruding leftward is provided on a left side surface 76L of the arm 76. The second protrusion 76B is inserted into the other opening 75B. The first protrusion 76A and the second protrusion 76B are movable in the up-down direction in the openings 75B. Therefore, the center pinch roller 72 is movable in the up-down direction in accordance with the thickness of the recording medium 5. The arm 76 includes an opening 76H, in which the center pinch roller 72 is accommodated. The second shaft 77B, supporting the center pinch roller 72 such that the center pinch roller 72 is rotatable, is provided in the arm 76 so as to extend through the opening 76H.

Figure 8:
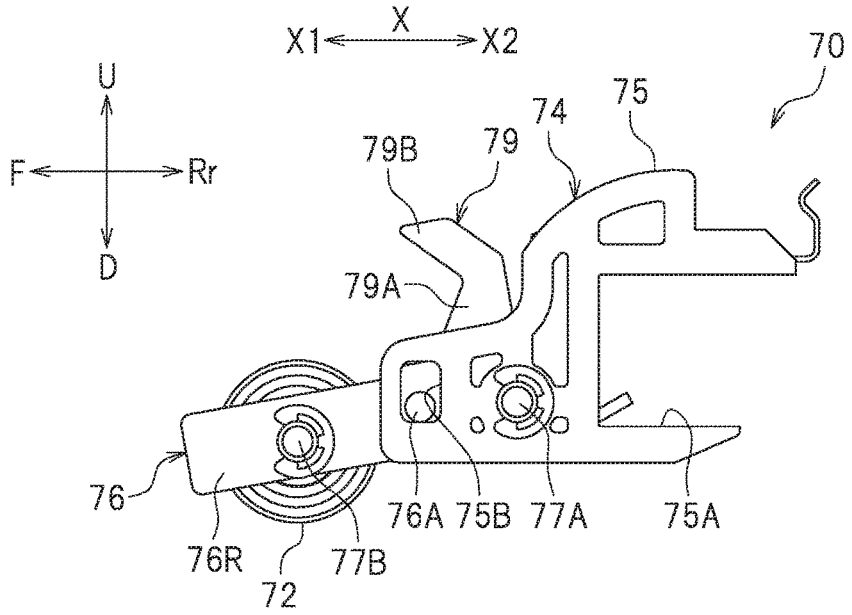
FIG. 8 is a side view of the center pinch roller unit according to a preferred embodiment of the present invention.
Figure 9:
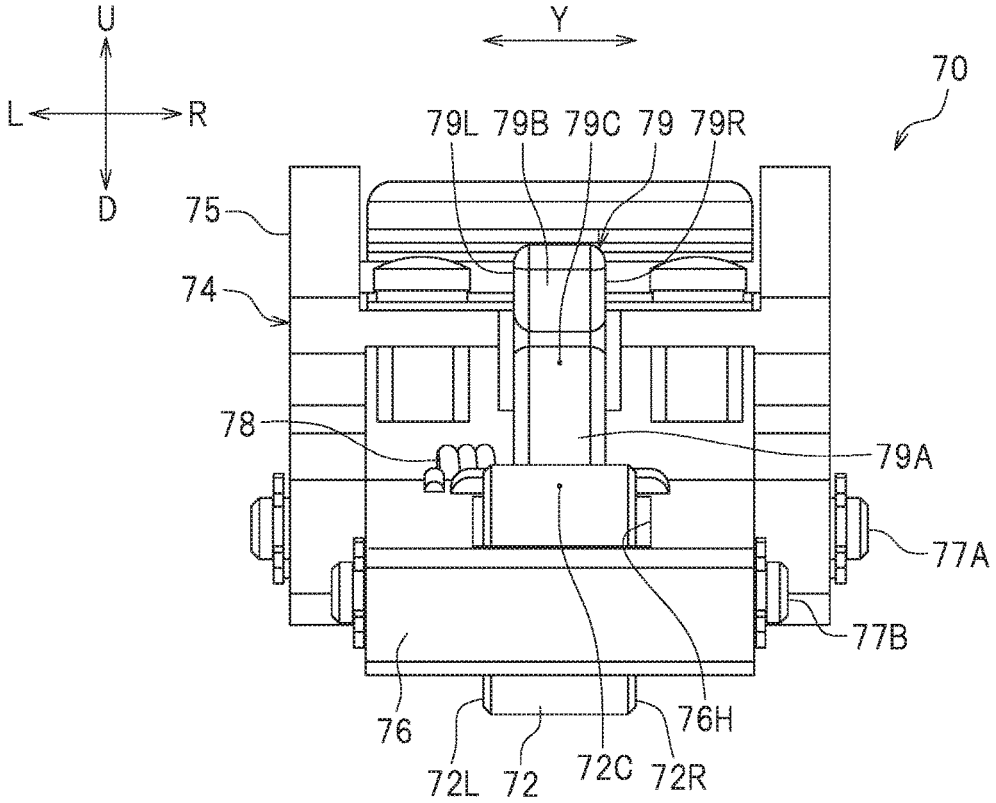
FIG. 9 is a front view of the center pinch roller unit according to a preferred embodiment of the present invention.

As shown in FIG. 8, the second holding member 74 includes a locking member 79 provided on the arm 76. The locking member 79 is allowed to contact, and to be separated from, an eccentric cam (see FIG. 4) described below. The locking member 79 is located between the first shaft 77A and the second shaft 77B in the sub scanning direction X. The locking member 79 extends from the arm 76 toward the eccentric cam 88. The locking member 79 includes a first portion 79A extending obliquely in a rearward and upward direction from a rear end of the arm 76, and a second portion 79B extending obliquely in a forward and upward direction from a top end of the first portion 79A. As shown in FIG. 9, a left end 79L of the locking member 79 is located to the right of a left end 72L of the center pinch roller 72 as seen in a front view. A right end 79R of the locking member 79 is located to the left of a right end 72R of the center pinch roller 72 as seen in a front view. In this preferred embodiment, a center 79C of the locking member 79 in the main scanning direction Y and a center 72C of the center pinch roller 72 in the main scanning direction Y overlap each other in the main scanning direction Y. The locking member 79 is made of, for example, zinc by die-casting.

As shown in FIG. 9, the twisted coil spring 78 is wound around the first shaft 77A. The twisted coil spring 78 is located to the left of the locking member 79. Alternatively, the twisted coil spring 78 may be located to the right of the locking member 79. The twisted coil spring 78 is locked on the arm 76. The twisted coil spring 78 urges the arm 76 downward. The twisted coil spring 78 has a stress smaller than a stress of each of the twisted coil springs 68 used in the side pinch roller units 60. In this preferred embodiment, there is one twisted coil spring 78. There may be any other number of twisted coil springs 78.

Figure 10:
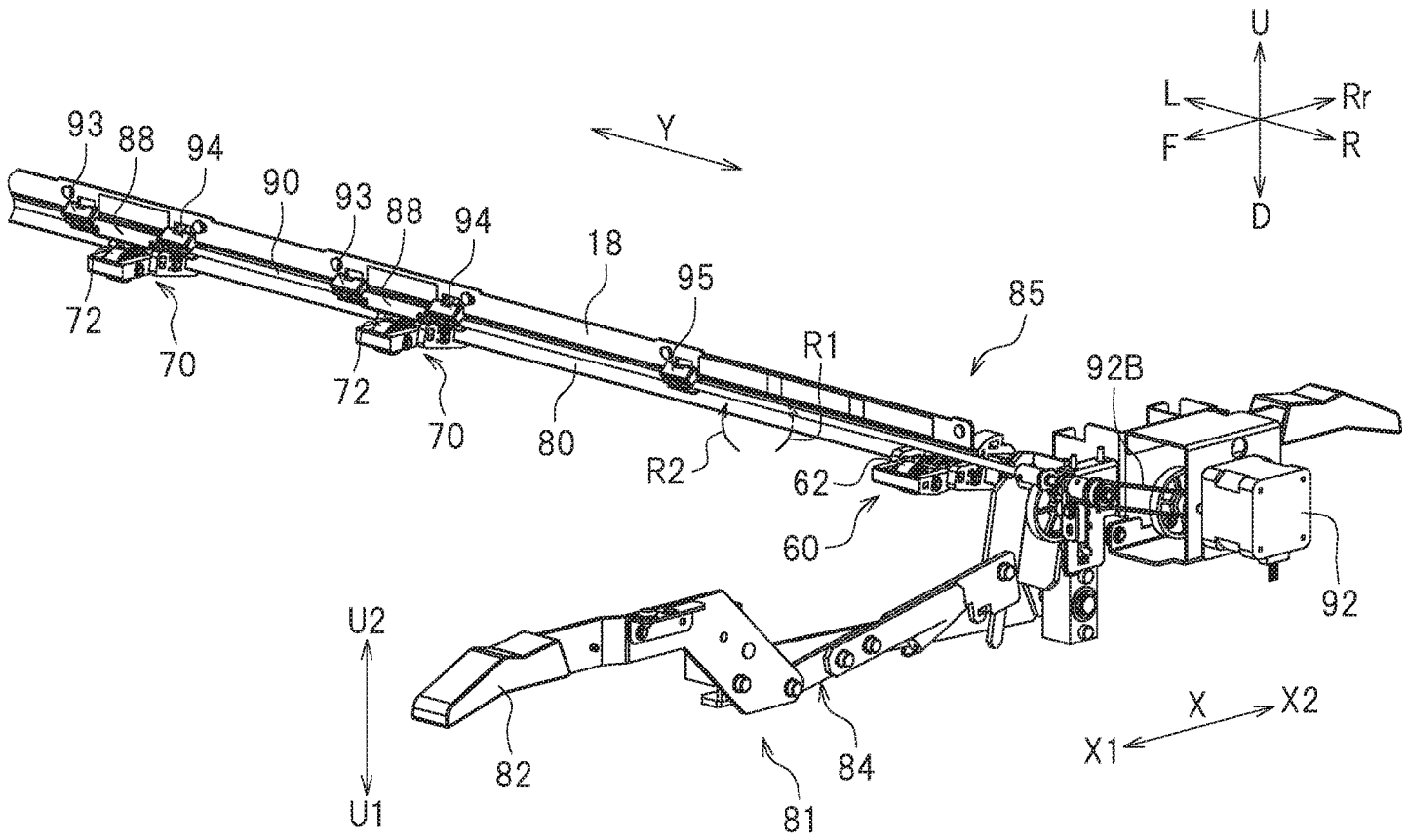
FIG. 10 is a perspective view of a center pinch roller lifting mechanism and a rotator according to a preferred embodiment of the present invention.
Figure 11:
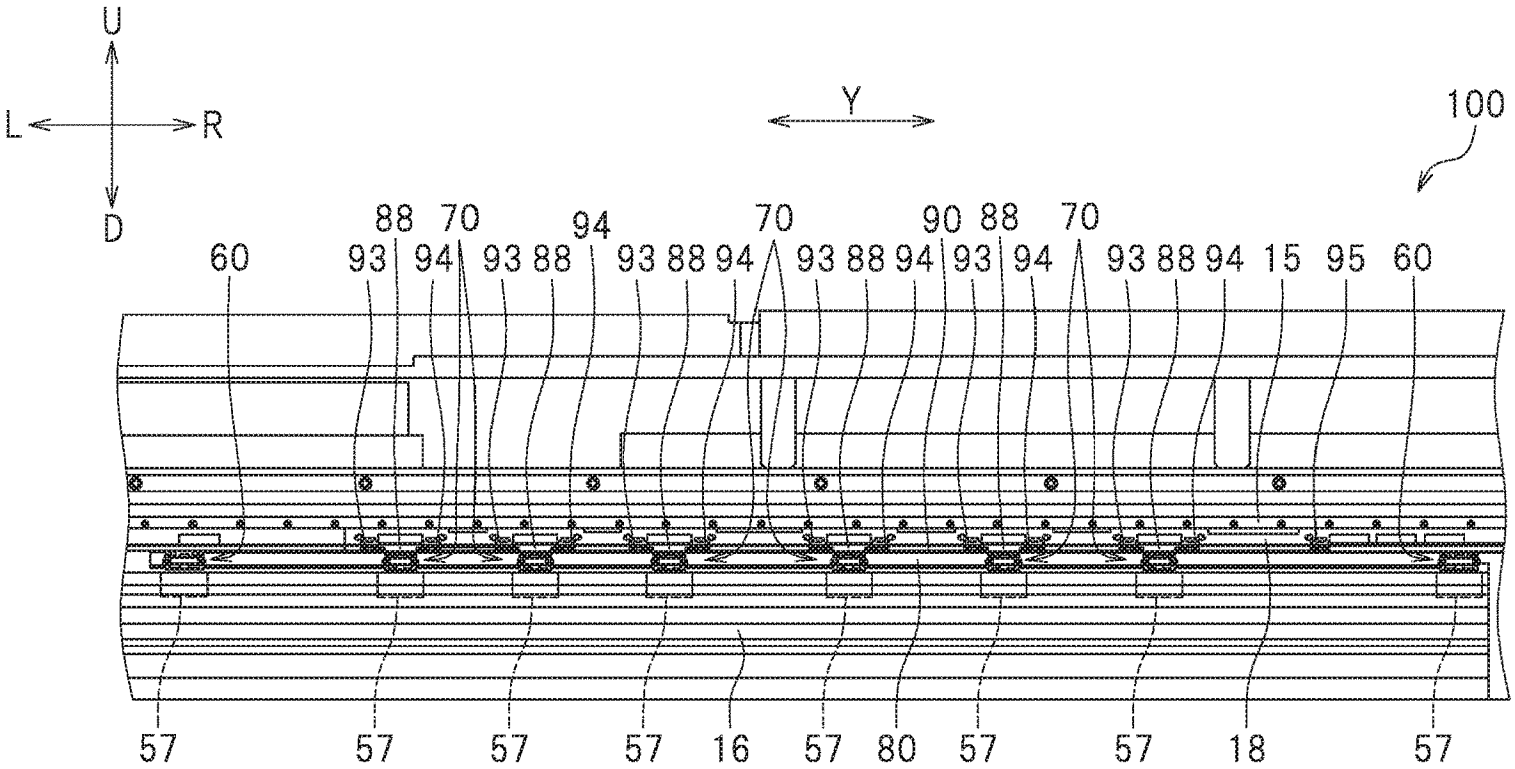
FIG. 11 is a front view of a portion of the printer according to a preferred embodiment of the present invention.
Figure 12:
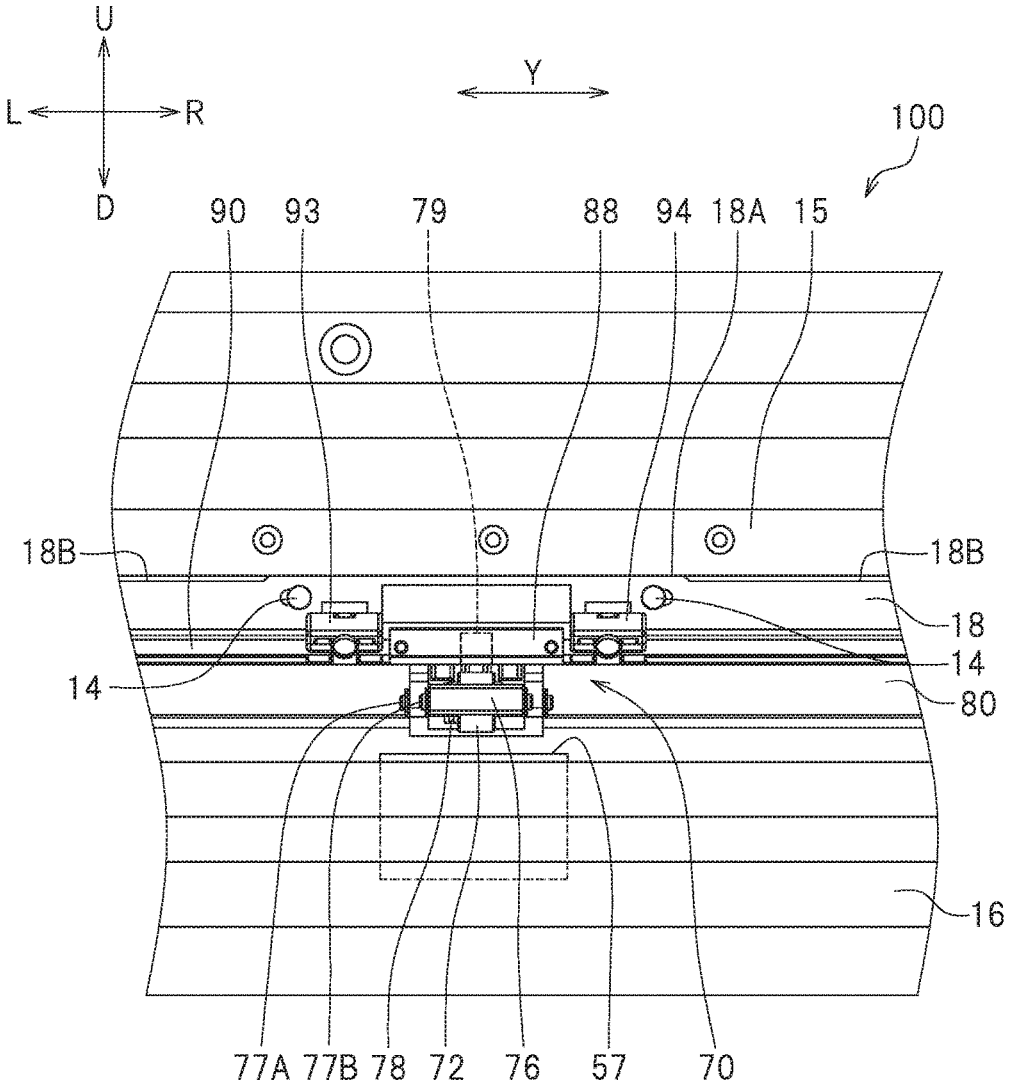
FIG. 12 is a front view showing a structure of the vicinity of the center pinch roller unit according to a preferred embodiment of the present invention.

As shown in FIG. 10, the first holding shaft 80 extends in the main scanning direction Y. As shown in FIG. 11, the first holding shaft 80 is located below the guide rail 15. As shown in FIG. 12, the first holding shaft 80 is located below a frame member 18 described below. The first holding shaft 80 is located above the platen 16. As shown in FIG. 13, the first holding shaft 80 has a rectangular cross-section. As shown in FIG. 11, the first holding shaft 80 holds the side pinch roller units 60 and the center pinch roller units 70. The first holding shaft 80 holds the side pinch rollers 62 and the center pinch rollers 72. In more detail, the first holding shaft 80 is fit into the recessed portion 65A located in the main body 65 of the first holding member 64 of each of the side pinch roller units 60. The first holding shaft 80 is fit into recessed portion 75A provided in the main body 75 of the second holding member 74 of each of the center pinch roller units 70. The side pinch roller units 60 and the center pinch roller units 70 are slidable with respect to the first holding shaft 80 so as to be changed in the position thereof in the main scanning direction Y.

As shown in FIG. 1, the rotator 81 is located to the right of the platen 16. Alternatively, the rotator 81 may be located to the left of the platen 16. As shown in FIG. 10, the rotator 81 rotates the first holding shaft 80 in a direction of arrow R1 and a direction of arrow R2 in FIG. 10. The rotator 81 includes a loading lever 82 and a link mechanism 84. The loading lever 82 is provided at a front end of the link mechanism 82. The loading lever 82 is located to the right of the platen 16. A rear end of the link mechanism 84 is connected with the first holding shaft 80. The loading lever 82 is manually operable. The loading lever 82 is indirectly connected with the first holding shaft 80 via the link mechanism 84. When the loading lever 82 is pushed down in a direction of arrow U1 in FIG. 10, the first holding shaft 80 is rotated in the direction of arrow R1 in FIG. 10. As a result, the side pinch rollers 62 and the center pinch rollers 72 approach the grit rollers 57 (see FIG. 4). The operator places the recording medium 5 on the platen 16 and then pushes down the loading lever 82 in the direction of arrow U1 in FIG. 10, and thus causes the recording medium 5 to be held between the side pinch rollers 62/the center pinch rollers 72 and the grit rollers 57. By contrast, when the loading lever 82 is pushed up in a direction of arrow U2 in FIG. 10, the first holding shaft 80 is rotated in the direction of arrow R2 in FIG. 10. As a result, the side pinch rollers 62 and the center pinch rollers 72 are separated from the grit rollers 57. When the printing is finished or the cutting is finished, the operator pushes up the loading lever 82 in the direction of arrow U2 in FIG. 10, and thus causes the recording medium 5 to be removed from the platen 16.

As shown in FIG. 10, the center pinch roller lifting mechanism 85 is located above the first holding shaft 80. The center pinch roller lifting mechanism 85 includes a second holding shaft 90, a plurality of the eccentric cams 88, a motor 92, first support members 93, second support members 94 and a third support member 95.

As shown in FIG. 10, the second holding shaft 90 extends in the main scanning direction Y. As shown in FIG. 13, the second holding shaft 90 is located below the guide rail 15 as seen in an axial direction of the second holding shaft 90. The second holding shaft 90 is located to the rear of a front end of the guide rail 15. The second holding shaft 90 is located above the platen 16. The second holding shaft 90 is parallel to the first holding shaft 80. The second holding shaft 90 is located above the first holding shaft 80. The second holding shaft 90 is located to the front of the first holding shaft 80. The second holding shaft 90 is located to the rear of the center pinch rollers 72. A center axis 90C of the second holding shaft 90 is located to the rear of a center axis 72H of the center pinch rollers 72 as seen in the axial direction of the second holding shaft 90. The second holding shaft is located above the center pinch rollers 72. The second holding shaft 90 is located to the rear of the second axis 77B of the center pinch roller unit 70. The second holding shaft 90 causes the center pinch rollers 72 to approach, or to be separated from, the grit rollers 57, independently from the side pinch rollers 62. Namely, as described below, the second holding shaft 90 rotates to cause the center pinch rollers 72 to approach, or to be separated from, the grit rollers 57 indirectly via the eccentric cams 88, independently from the side pinch rollers 62. Alternatively, the second holding shaft 90 may rotate to directly press the center pinch rollers 72 so that the center pinch rollers approach, or are separated from, the grit rollers 57, independently from the side pinch rollers 62. The second holding shaft 90 has a circular cross-section. The second holding shaft 90 holds the eccentric cams 88. The second holding shaft 90 is made of a metal material. Length L2 of the second holding shaft 90 in the sub scanning direction X is shorter than length L1 of the first holding shaft 80 in the sub scanning direction X.

Figure 14:
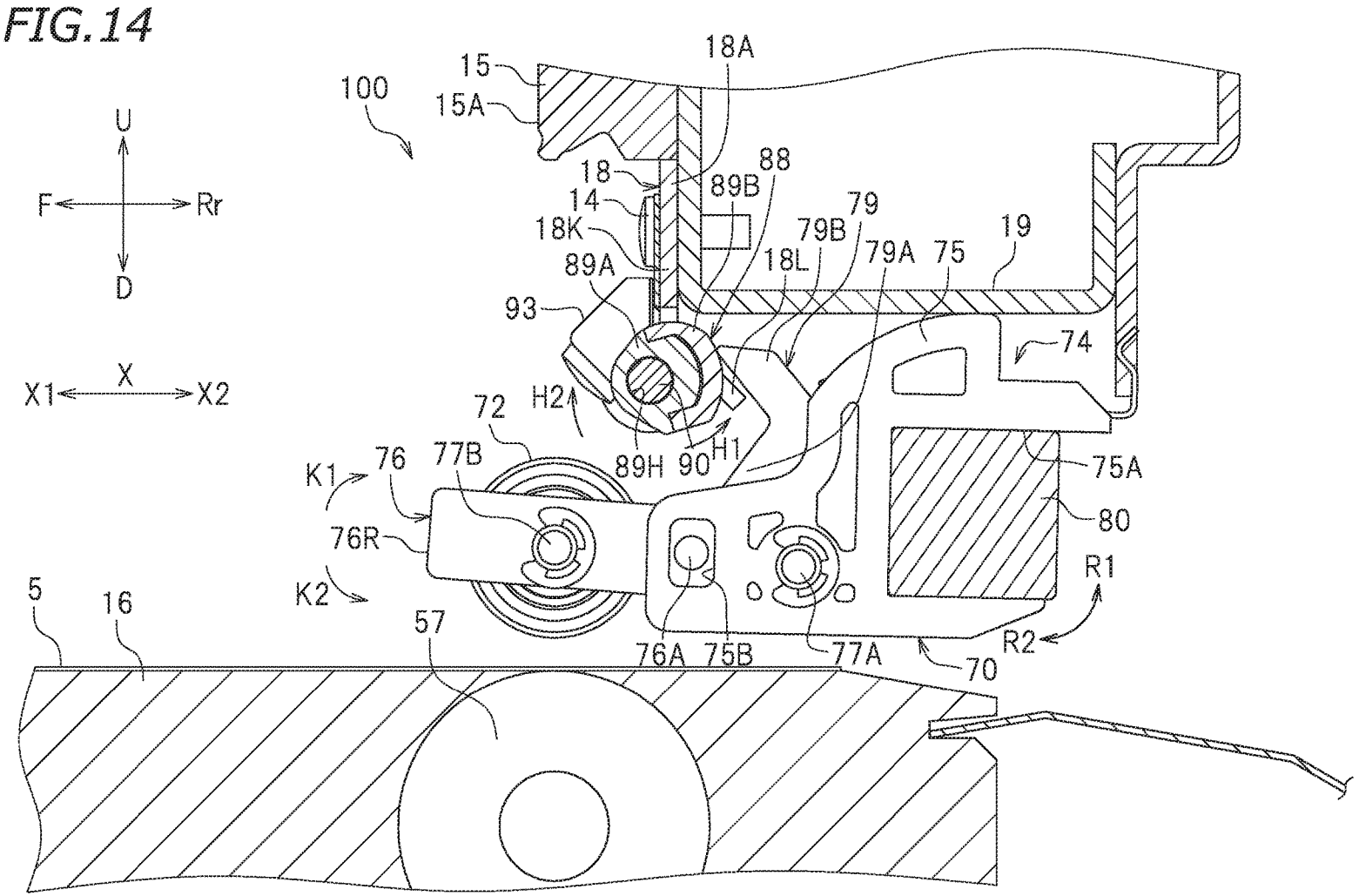
FIG. 14 is a partially cut cross-sectional view showing a structure of the center pinch roller unit and the vicinity thereof according to a preferred embodiment of the present invention.

As shown in FIG. 14, the eccentric cams 88 are each allowed to contact, and to be separated from, the locking member 79 of the second holding member 74. When the eccentric cam 88 contacts the locking member 79, the corresponding center pinch roller 72 is moved in such a direction as to be separated away from the grit roller 57. This will be described in more detail. The eccentric cam 88 contacts the locking member 79, and as a result, the locking member 79 is pushed up. Since the locking member 79 is formed on the arm 76, the arm 76 is pivoted, with respect to the main body 75, in a direction of arrow K1 shown in FIG. 13 as being centered around the first shaft 77A. As a result, the center pinch roller 72 rotatably supported by the second shaft 77B provided on the arm 76 is moved upward, and thus is separated from the grit roller 57 (see FIG. 14). The eccentric cam 88 is an example of contact member. The eccentric cam 88 is located above the grit roller 57. The eccentric cam 88 is located to the rear of a front end 15A of the guide rail 15. As shown in FIG. 13, while the second holding shaft 90 is not rotating, the eccentric cam 88 and the second holding member 74 are out of contact with each other.

As shown in FIG. 13, the distance between a rotation center 89C and an outer circumferential surface 89K of the eccentric cam 88 is not constant in the entirety thereof. The eccentric cam 88 includes a first portion 89X and a second portion 89Y. The distance between the rotation center 89C and the outer circumferential surface 89K of the first portion 89X is set such that the first portion 89X is out of contact with the locking member 79. The first portion 89X is set such that the distance between the rotation center 89C and the outer circumferential surface 89K gradually increases in a radial direction (gradually increases in the clockwise direction as seen in a right side view). The distance between the rotation center 89C and the outer circumferential surface 89K of the second portion 89Y is set such that the second portion 89Y is allowed to contact the locking member 79. The distance between the rotation center 89C and the outer circumferential surface 89K of the second portion 89Y is longer than that of the first portion 89X. The distance between the rotation center 89C and the outer circumferential surface 89K of the second portion 89Y is constant in the entirety thereof. The rotation center 89C of the eccentric cam 88 matches the center axis 90C of the second holding shaft 90. The rotation center 89C of the eccentric cam 88 does not need to match the center axis 90C of the second holding shaft 90.

As shown in FIG. 13, the eccentric cam 88 includes a first member 89A and a second member 89B. The first member 89A includes an insertion hole 89H, into which the second holding shaft 90 is inserted. The first member 89A rotates integrally with the second holding shaft 90. The first member 89A is made of a metal material. The first member 89A and the second holding shaft 90 are secured to each other via, for example, a screw. The second member 89B is made of, for example, a resin material. The second member 89B is allowed to contact the locking member 79 of the second holding member 74. The second member 89B includes a recessed portion 89BX. A protrusion 89AX of the first member 89A is fit into the recessed portion 89BX, and thus the second member 89B is attached to the first member 89A.

As shown in FIG. 10, the motor 92 is connected with a right end of the second holding shaft 90 via a belt 92B. The motor 92 and the belt 92B are located to the right of the platen 16. Alternatively, the motor 92 and the belt 92B may be located to the left of the platen 16. In the latter case, the motor 92 may be connected with a left end of the second holding shaft 90 via the belt 92B. The motor 92 is indirectly connected with the second holding shaft 90 via the belt 92B. The motor 92 is an example of second rotator. The motor 92 is controlled by the controller 50 (see FIG. 3). The motor 92 is driven to run the belt 92B, and as a result, the second holding shaft 90 rotates. As shown in FIG. 13, the second holding shaft 90 may be rotated in a direction of arrow H1 in FIG. 13, so that the eccentric cam 88 contacts the locking member 79 of the second holding member 74. By contrast, the second holding shaft 90 may be rotated in a direction of arrow H2 in FIG. 13, so that the eccentric cam 88 is separated away from the locking member 79 of the second holding member 74.

Figure 15:
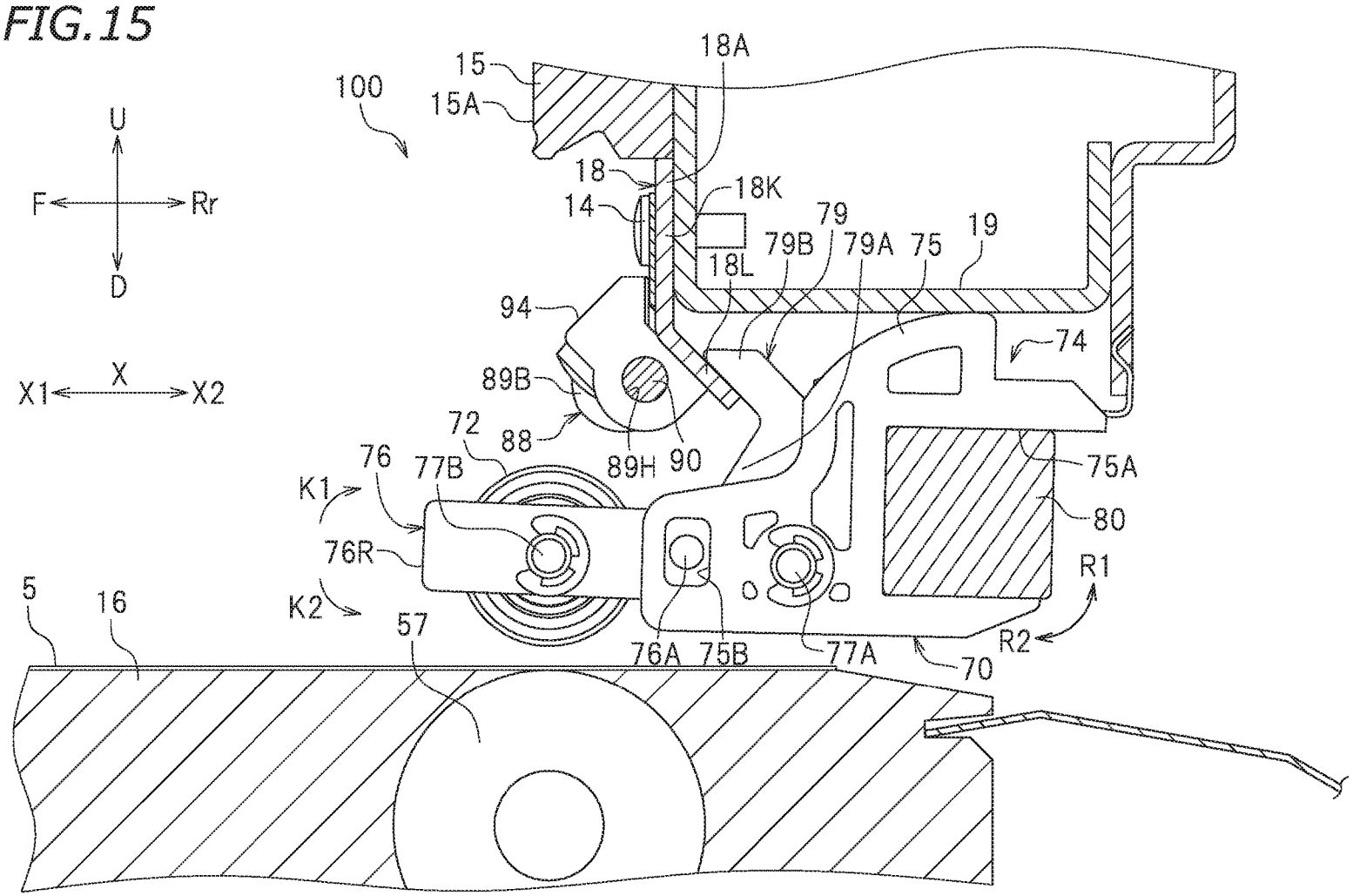
FIG. 15 is a partially cut cross-sectional view showing a structure of the center pinch roller unit and the vicinity thereof according to a preferred embodiment of the present invention.

As shown in FIG. 4, the frame member 18 is provided below the guide rail 15. The frame member 18 extends in the main scanning direction Y. As shown in FIG. 12, the frame member 18 includes a protrusion 18A in contact with the guide rail 15 and a recessed portion 18B out of contact with the guide rail 15. The eccentric cam 18 is located between a left end and a right end of the protrusion 18A of the frame member 18. As shown in FIG. 15, the frame member 18 is secured, via a screw 14, to the main body frame 19, to which the guide rail 15 is secured. The frame member 18 includes a vertical wall 18K extending in the up-down direction and an inclining wall 18L extending obliquely in a rearward and downward direction from a bottom end of the vertical wall 18K. The "vertical wall 18K" does not need to extend exactly vertically. As shown in FIG. 13, the inclining wall 18L is not present to the rear of the eccentric cam 88. The inclining wall 18L is not present above the grit roller 57. The inclining wall 18L inhibits the center pinch rollers 72 from moving downward. Namely, when the grit rollers 57 are not present below the center pinch rollers 72 and the first holding shaft 80 rotates in the direction of arrow R1 in FIG. 15, the inclining wall 18L contacts the second portion 79B of the locking member 79 of the second holding member 74. Therefore, the arm 76 of the second holding member 74 is prevented from pivoting in the direction of arrow K2 in FIG. 15 as being centered around the first shaft 77A. For this reason, even if the first holding shaft 80 rotates in the direction of arrow R1 in FIG. 15, the center pinch rollers 72 do not move downward. Namely, the center pinch rollers 72 and the grit rollers 75 do not contact each other.

As shown in FIG. 11, the first support members 93, the second support members 94 and the third support member 95 support the second holding shaft 90. The first support members 93, the second support members 94 and the third support member 95 are attached to the frame member 18. The first support members 93 are each located to the left of the corresponding eccentric cam 88. The second support members 94 are each located to the right of the corresponding eccentric cam 88. The third support member 95 is located between one of the side pinch roller units 60 and the center pinch roller unit 70 adjacent to the one side pinch roller unit 60.

As shown in FIG. 3, the controller 50 controls the printing on the recording medium 5 and the cutting of the recording medium 5. There is no specific limitation on the structure of the controller 50. The controller 50 is, for example, a microcomputer. There is no specific limitation on the hardware structure of the microcomputer. The microcomputer includes, for example, an I/F, a CPU, a ROM, a RAM and a storage device. As shown in FIG. 1, the controller 50 is provided in the printer main body 100*a*. The controller 50 does not need to be provided in the printer main body 100*a*. The controller 50 may be, for example, a computer provided outside the printer main body 100*a*. In this case, the controller 50 is communicably connected with the printer main body 100*a* in a wired or wireless manner.

As shown in FIG. 3, the controller 50 controls the driving of the carriage motor 44 to control the rotation of the pulley 42 and the running of the belt 43 (see FIG. 1). Thus, the controller 50 controls the movement of the inkjet head 20 and the cutting head 30 in the main scanning direction Y. The controller controls the driving of the feed motor 58 to control the rotation of the grit rollers 57. Thus, the controller 50 controls the movement of the recording medium 5 placed on the platen 16 in the sub scanning direction X. The controller 50 controls the timing at which the inkjet head 20 discharges ink, the amount of ink to be discharged, and the like. The controller 50 controls the solenoid 32 to control the movement of the cutter 33 in the up-down direction and the pressure of the cutter 33. The controller 50 controls the driving of the motor 92 to control the rotation of the second holding shaft 90. Thus, the center pinch rollers 72 are made movable upward. The controller 50 does not drive the motor 92 before or during the printing performed by the inkjet head 20. The controller 50 drives the motor 92 after the inkjet head 20 finishes the printing. Thus, the eccentric cams 88 contact the locking members 79 of the second holding members 74 to move the center pinch rollers 72 upward.

Now, an operation of the side pinch roller units 60 and the center pinch roller units 70 will be described. For the sake of simplicity, the operation of one side pinch roller unit 60 and one center pinch roller unit 70 will be described. As shown in FIG. 4, when the recording medium 5 is to be placed on the platen 16, the side pinch roller 62 and the center pinch roller 72 are separate from the grit roller 57. When the positional alignment of the recording medium 5 and the platen 16 is finished, the operator pushes down the loading lever 82 in the direction of arrow U1 in FIG. 10. As a result, the first holding shaft 80 rotates in the direction of arrow R1 in FIG. 10. The first holding shaft 80 holds the first holding member 64 and the second holding member 74. Therefore, the first holding member 64 and the second holding member 74 also rotate in the direction of arrow R1 in FIG. 10. Thus, the side pinch roller 62 and the center pinch roller 72 approach the grit roller 57. As a result, the recording medium 5 is held between the side pinch roller 62 and the grit roller 57 and between the center pinch roller 72 and the grit roller 57 (see FIG. 13). Then, the inkjet head 20 performs the printing on the recording medium 5 placed on the platen 16. At this point, the grit roller 57 rotates to move the recording medium 5 from the upstream position toward the downstream position (i.e., in the sub scanning direction X1).

When the printing is finished, the recording medium 5 needs to be moved from the downstream position toward the upstream position (i.e., in the sub scanning direction X2) in order to be cut. If the recording medium 5 is moved from the downstream position toward the upstream position while being held between the center pinch roller 72 and the grit roller 57, the center pinch roller 72 moves on the printed image, which may influence the quality of the image. Therefore, when the printing is finished, the controller 50 drives the motor 92 to rotate the second holding shaft 90 in the direction of arrow H1 in FIG. 13. Thus, the eccentric cam 88 also rotates in the direction of arrow H1, and pushes up the locking member 79 of the second holding member 74. As a result, as shown in FIG. 14, the center pinch roller 72 moves upward, and thus is separated from the grit roller 57. Namely, the center pinch roller 72 is moved in such a direction as to be separated away from the grit roller 57 (i.e., from the recording medium 5), independently from the side pinch roller 62, with no rotation of the first holding shaft 80 (i.e., in the state in which the first holding shaft 80 is not rotating). Even if the second holding shaft 90 rotates, the side pinch roller 62 does not move upward. Therefore, the recording medium 5 is kept held between the side pinch roller 62 and the grit roller 57. Then, the grit roller 57 is driven to return the recording medium 5 from the downstream position to the upstream position, and the cutting of the recording medium 5 is started. When the cutting of the recording medium 5 is finished, the operator pushes up the loading lever 82 in the direction of arrow U2 in FIG. 10. Thus, the first holding shaft 80 rotates in the direction of arrow R2 in FIG. 10. As a result, the side pinch roller 62 is separated from the grit roller 57, and thus the recording medium 5 is removable from the platen 16. After the cutting is finished, the controller 50 drives the motor 92 to rotate the second holding shaft 90 in the direction of arrow H2 in FIG. 14. As a result, the eccentric cam 88 also rotates in the direction of arrow H2, and is separated from the locking member 79. Thus, the center pinch roller 72 is moved downward.

As described above, in the printer 100 in this preferred embodiment, the rotator 81 rotates the first holding shaft 80 to cause the side pinch rollers 62 and the center pinch rollers 72 to approach the grit rollers 57. With such a structure, the recording medium 5 is held between the side pinch rollers 62 and the grit rollers 57 and between the center pinch rollers 72 and the grit rollers 57. In this manner, at the time of the printing, the defect that the image quality is varied region by region in the entirety of the recording medium 5 in the main scanning direction Y is reduced or prevented. In addition, the center pinch rollers 72 are movable, from the state in which the side pinch rollers 62 and the center pinch rollers 72 hold the recording medium 5 together with the grit rollers 57, in such a direction as to be separated away from the recording medium 5, independently from the side pinch rollers 62. As a result, a state is realized where the side pinch rollers 62 and the grit rollers 57 hold the recording medium 5 whereas the center pinch rollers 72 and the grit rollers do not hold the recording medium 5. Therefore, when the recording medium 5 is to be subjected to the printing again after being returned to the printing start position, the recording medium 5 is prevented from being positionally shifted.

With the printer 100 in this preferred embodiment, the motor 92 rotates the second holding shaft 90 to put the eccentric cams 88 into contact with the second holding members 74. With such a structure, the center pinch rollers 72 are movable in such a direction as to be separated away from the recording medium 5 (in this example, movable upward). As a result, a state is realized where the side pinch rollers 62 and the grit rollers 57 hold the recording medium 5 whereas the center pinch rollers 72 and the grit rollers 57 do not hold the recording medium 5. Therefore, when the recording medium 5 is to be cut after being returned to the printing start position, the recording medium 5 is suppressed from being positionally shifted.

With the printer 100 in this preferred embodiment, the eccentric cams 88 allowed to contact, and to be separated from, the locking members 79 are held by the second holding shaft 90, which is different from the first holding shaft 80 holding the center pinch rollers 72 and the side pinch rollers 62. With such a structure, even when each of the eccentric cams 88 contacts the corresponding locking member 79 and as a result, the arm 76 of the corresponding second holding member 74 holding the center pinch roller 72 pivots with respect to the main body 75, the first holding member 64 holding the corresponding side pinch roller 62 does not pivot. Therefore, the eccentric cams 88 contact the locking members 79 to separate only the center pinch rollers 72 from the grit rollers 57 without changing the state in which the recording medium 5 is held between the side pinch rollers 62 and the grit rollers 57.

With the printer 100 in this preferred embodiment, the eccentric cams 88 each include the first portion 89X, in which the distance between the rotation center 89C and the outer circumferential surface 89K is set such that the first portion 89X is out of contact with the locking member 79, and also include the second portion 89Y, in which the distance between the rotation center 89C and the outer circumferential surface 89K is longer than that of the first portion 89X. With such a structure, the center pinch rollers 72 are allowed to be separated from, and to contact, the recording medium 5.

With the printer 100 in this preferred embodiment, the first member 89A and the second holding shaft 90 are made of a metal material, and therefore, are secured strongly to each other. The second member 89B in contact with the second holding member 74 is made of a resin material, and therefore, is highly durable.

With the printer 100 in this preferred embodiment, the eccentric cams 88 each push up the corresponding locking member 79 to move the center pinch roller 72 upward. With such a simple structure in which the eccentric cam 88 contacts and pushes up the locking member 79, the center pinch roller 72 is moved upward.

With the printer 100 in this preferred embodiment, the left end 79L of the locking member 79 is located to the right of the left end 72L of the center pinch roller 72 as seen in a front view. The right end 79R of the locking member 79 is located to the left of the right end 72R of the center pinch roller 72 as seen in a front view. With such a structure, the center pinch roller 72 is lifted up with a relatively small force.

With the printer 100 in this preferred embodiment, the center 79C of the locking member 79 in the main scanning direction Y and the center 72C of the center pinch roller 72 in the main scanning direction Y overlap each other in the main scanning direction Y. With such a structure, the center pinch roller 72 is lifted up with a relatively small force.

With the printer 100 in this preferred embodiment, the first support members 93 support the second holding shaft 90 and are each attached to a portion of the frame member 18 that is to the left of the corresponding eccentric cam 88. The second support members 94 support the second holding shaft 90 and are each attached to a portion of the frame member 18 that is to the right of the corresponding eccentric cam 88. With such a structure, the second holding shaft 90 is prevented from sagging due to the reaction force of the second holding members 74 applied to the second holding shaft 90 via the eccentric cams 88. Namely, the center pinch rollers 72 are moved upward more certainly.

With the printer 100 in this preferred embodiment, the frame member 18 includes the inclining wall 18L. When the grit rollers 57 are not located below the center pinch rollers 72 and the first holding shaft 80 rotates, the inclining wall 18L contacts the second holding members 74 to inhibit the center pinch rollers 72 from moving downward. In this manner, in the case where the grit rollers 57 are not located below the center pinch rollers 72, the frame member 18 prevents the center pinch rollers 72 from contacting the recording medium 5.

With the printer 100 in this preferred embodiment, the controller 50 does not drive the motor 92 before and during the printing performed by the inkjet head 20. With such an arrangement, the recording medium 5 is held between the side pinch rollers 62 and the grit rollers 57 and between the center pinch rollers 72 and the grit rollers 57. After the inkjet head 20 finishes the printing, the controller 50 drives the motor 92 to put the eccentric cams 88 into contact with the second holding members 74 and thus to move the center pinch rollers 72 upward. As a result, the recording medium 5 is held only between the side pinch rollers 62 and the grit rollers 57.

The printer 100 in this preferred embodiment includes the second holding shaft 90, which causes at least one center pinch roller 72 to contact, and to be separated from, the grit roller 57, independently from the side pinch rollers 62. Use of the second holding shaft 90 allows the center pinch roller 72 to contact, and to be separated from, the grit roller 57, independently from the side pinch rollers 62, with a simple structure.

With the printer 100 in this preferred embodiment, length L2 of the second holding shaft 90 in the sub scanning direction X is shorter than length L1 of the first holding shaft 80 in the sub scanning direction X. With such a structure, the second holding shaft 90 and the eccentric cams 88 are located in a compact manner in the sub scanning direction X.

With the printer 100 in this preferred embodiment, the first holding shaft 80 is connected with the loading lever 82 operable manually, and the second holding shaft 90 is connected with the motor 92 rotating the second holding shaft 90. Such a simple structure allows the second holding shaft 90 to rotate independently from the first holding shaft 80.

With the printer 100 in this preferred embodiment, the loading lever 82 and the motor 92 are located to the right of the platen 16 in the main scanning direction Y. Since the loading lever 82 and the motor 92 are located on the same side with respect to the platen 16 in this manner, the printer 100 is prevented from being increased in size in the main scanning direction Y.

With the printer 100 in this preferred embodiment, the first holding shaft 80 is fit into the recessed portions 75A provided in the second holding members 74, and the eccentric cams provided on the second holding shaft 90 contact, and are separated from, the second holding members 74. In this manner, the center pinch rollers 72 are caused to contact, and to be separated from, the grit rollers 57, independently from the side pinch rollers 62. As a result, the second holding members 74 are rotated with no delay by the first holding shaft 80, whereas the second holding members 74 are rotated by the second holding shaft 90 in accordance with the content of operation to be performed on the recording medium 5.

The printer 100 in this preferred embodiment includes the second holding members 74, which are held by the first holding shaft 80, extend forward from the first holding shaft 80, and hold the center pinch rollers 72 such that the center pinch rollers 72 are rotatable. The second holding shaft 90 is located to the front of the first holding shaft 80 and above the center pinch rollers 72 as seen in the axial direction of the second holding shaft 90. The dead space around the second holding members 74 is effectively used in this manner to locate the second holding shaft 90 in a compact manner.

With the printer 100 in this preferred embodiment, the center axis 90C of the second holding shaft 90 is located to the rear of the center axis 72H of the center pinch rollers 72 as seen in the axial direction of the second holding shaft 90. The dead space around the second holding members 74 is effectively used in this manner to locate the second holding shaft 90 in a compact manner.

The printer 100 in this preferred embodiment includes the cutting head 30, which is movable in the main scanning direction Y and cuts the recording medium 5 placed on the platen 16. With such a structure, when the recording medium 5 is to be cut after having an image printed thereon and being returned to the print start position, the recording medium 5 is prevented from being positionally shifted.

Preferred embodiments according to the present invention are described above. The above-described preferred embodiments are merely examples, and the present invention may be carried out in any of various other forms.

In the above-described preferred embodiments, the rotation of the second holding shaft 90 is controlled by the driving of the motor 92. Alternatively, the operator may manually rotate the second holding shaft 90, like the first holding shaft 80.

In the above-described preferred embodiments, the driving force of the motor 92 is transmitted to the second holding shaft 90 via the belt 92B. The manner of transmission is not limited to this. The motor 92 may be directly connected with the second holding shaft 90.

The above-described preferred embodiments relate to an inkjet printer including a cutting head. Preferred embodiments of the present invention are applicable to a printer with no cutting head.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

a table on which a recording medium is to be placed;

an inkjet head that is movable in a first direction and performs printing on the recording medium placed on the table; and a moving mechanism that moves the recording medium placed on the table in a second direction crossing the first direction; wherein the moving mechanism includes:

a pair of side pinch rollers that are located above the table, are rotatable, and press both of two ends of the recording medium in the first direction;

at least one center pinch roller that is provided between the pair of side pinch rollers, is rotatable, and presses the recording medium;

a first holding shaft that extends in the first direction and holds the pair of side pinch rollers and the at least one center pinch roller;

a plurality of driving rollers that are arrayed in the first direction, are located below the pair of side pinch rollers and the at least one center pinch roller, and move the recording medium in the second direction while holding the recording medium together with the pair of side pinch rollers and together with the at least one center pinch roller;

a first rotator that rotates the first holding shaft so as to cause the pair of side pinch rollers and the at least one center pinch roller to approach, or to be separated from, the plurality of driving rollers;

a first holding member that is held by the first holding shaft and holds each of the pair of side pinch rollers such that the respective side pinch roller is rotatable;

a second holding member that is held by the first holding shaft and holds the at least one center pinch roller such that the at least one center pinch roller is rotatable;

a contact member that is located above each of the plurality of driving rollers, and contacts the second holding member to cause the at least one center pinch roller to move in such a direction as to be separated from a corresponding driving roller among the plurality of driving rollers;

a second holding shaft that extends in the first direction and holds the contact member; and a second rotator that rotates the second holding shaft so as to cause the contact member to contact, and to be separated from, the second holding member; and the at least one center pinch roller is movable, from a state in which the pair of side pinch rollers and the at least one center pinch roller hold the recording medium together with the plurality of driving rollers, in such a direction as to be separated from the recording medium, independently from the pair of side pinch rollers, in a state in which the first holding shaft is not rotating.

2. The inkjet printer according to claim 1, wherein the second holding member includes:

a main body that holds the first holding shaft;

a first rotation shaft rotatably supported by the main body;

an arm held by the first rotation shaft to be pivotable with respect to the main body;

a second rotation shaft that is provided on the arm and supports the at least one center pinch roller such that the at least one center pinch roller is rotatable; and a locking member that is allowed to contact, and to be separated from, the contact member, and contacts the contact member to cause the arm to pivot with respect to the main body.

3. The inkjet printer according to claim 2, wherein the contact member includes an eccentric cam including a first portion in which a distance between a rotation center and an outer circumferential surface is set such that the first portion is out of contact with the locking member, and also including a second portion in which a distance between the rotation center and an outer circumferential surface is longer than that of the first portion.

4. The inkjet printer according to claim 3, wherein the second holding shaft is made of a metal material; and the eccentric cam includes:

a first member that includes an insertion hole into which the second holding shaft is inserted, rotates integrally with the second holding shaft, and is made of a metal material; and a second member that is made of a resin material and is attached to the first member so as to be allowed to contact the second holding member.

5. The inkjet printer according to claim 2, wherein the locking member is provided between the first rotation axis and the second rotation axis in the second direction so as to be allowed to contact the contact member, and extends from the arm toward the contact member; and the contact member pushes up the locking member to move the at least one center pinch roller upward.

6. The inkjet printer according to claim 5, wherein a left end of the locking member is located to the right of a left end of the at least one center pinch roller as seen in a front view; and a right end of the locking member is located to the left of a right end of the at least one center pinch roller as seen in a front view.

7. The inkjet printer according to claim 6, wherein a center of the locking member in the first direction and a center of the at least one center pinch roller in the first direction overlap each other in the first direction.

8. The inkjet printer according to claim 1, further comprising:

a guide rail that extends in the first direction and on which the inkjet head is movably provided;

a frame member that extends in the first direction and is provided below the guide rail;

a first support member that supports the second holding shaft and is attached to a portion of the frame member that is on one side with respect to the contact member in the first direction; and a second support member that supports the second holding shaft and is attached to a portion of the frame member that is on the other side with respect to the contact member in the first direction.

9. The inkjet printer according to claim 8, wherein the second holding member is provided on the first holding shaft so as to be slidable in the first direction; and when no driving roller is present below the at least one center pinch roller and the first holding shaft rotates, the frame member contacts the second holding member to inhibit the at least one center pinch roller from moving downward.

10. The inkjet printer according to claim 1, further comprising a controller that controls the inkjet head and the second rotator; wherein the controller does not drive the second rotator before or during the printing performed by the inkjet head, and after the inkjet head finishes the printing, the controller drives the second rotator to put the contact member into contact with the second holding member and thus to move the at least one center pinch roller upward.

11. An inkjet printer including a cutting head, comprising:

the inkjet printer according to claim 1; and a cutting head that is movable in the first direction and cuts the recording medium placed on the table.

12. An inkjet printer comprising:

a table on which a recording medium is to be placed;

an inkjet head that is movable in a first direction and performs printing on the recording medium placed on the table; and a moving mechanism that moves the recording medium placed on the table in a second direction crossing the first direction, wherein:

the moving mechanism includes:

a pair of side pinch rollers that are located above the table, are rotatable, and press both of two ends of the recording medium in the first direction;

at least one center pinch roller that is provided between the pair of side pinch rollers, is rotatable, and presses the recording medium;

a first holding shaft that extends in the first direction and holds the pair of side pinch rollers and the at least one center pinch roller;

a plurality of driving rollers that are arrayed in the first direction, are located below the pair of side pinch rollers and the at least one center pinch roller, and move the recording medium in the second direction while holding the recording medium together with the pair of side pinch rollers and together with the at least one center pinch roller;

a first rotator that rotates the first holding shaft so as to cause the pair of side pinch rollers and the at least one center pinch roller to approach, or to be separated from, the plurality of driving rollers; and a second holding shaft that causes the at least one center pinch roller to approach, or to be separated from, a corresponding driving roller among the plurality of driving rollers, independently from the pair of side pinch rollers;

the at least one center pinch roller is movable, from a state in which the pair of side pinch rollers and the at least one center pinch roller hold the recording medium together with the plurality of driving rollers, in such a direction as to be separated from the recording medium, independently from the pair of side pinch rollers, in a state in which the first holding shaft is not rotating;

the first rotator includes a lever that is manually operable;

the first holding shaft is connected with the lever; and the second holding shaft is connected with a motor that rotates the second holding shaft.

13. The inkjet printer according to claim 12, wherein a length of the second holding shaft in the second direction is shorter than a length of the first holding shaft in the second direction.

14. The inkjet printer according to claim 12, wherein the lever and the motor are located on one side with respect to the table in the first direction.

15. The inkjet printer according to claim 12, wherein the first holding shaft has a rectangular or substantially rectangular cross-section; and the second holding shaft has a circular or substantially circular cross-section.

16. The inkjet printer according to claim 12, further comprising a holding member that is held by the first holding shaft, extends forward from the first holding shaft, and holds the at least one center pinch roller such that the at least one center pinch roller is rotatable; wherein the second holding shaft is located to the front of the first holding shaft and above the at least one center pinch roller as seen in an axial direction of the second holding shaft.

17. The inkjet printer according to claim 16, wherein a center axis of the second holding shaft is located to the rear of a center axis of the at least one center pinch roller as seen in the axial direction of the second holding shaft.

18. An inkjet printer, comprising:

a table on which a recording medium is to be placed;

an inkjet head that is movable in a first direction and performs printing on the recording medium placed on the table; and a moving mechanism that moves the recording medium placed on the table in a second direction crossing the first direction, wherein the moving mechanism includes:

a pair of side pinch rollers that are located above the table, are rotatable, and press both of two ends of the recording medium in the first direction;

at least one center pinch roller that is provided between the pair of side pinch rollers, is rotatable, and presses the recording medium;

a first holding shaft that extends in the first direction and holds the pair of side pinch rollers and the at least one center pinch roller;

a plurality of driving rollers that are arrayed in the first direction, are located below the pair of side pinch rollers and the at least one center pinch roller, and move the recording medium in the second direction while holding the recording medium together with the pair of side pinch rollers and together with the at least one center pinch roller;

a first rotator that rotates the first holding shaft so as to cause the pair of side pinch rollers and the at least one center pinch roller to approach, or to be separated from, the plurality of driving rollers;

a second holding shaft that causes the at least one center pinch roller to approach, or to be separated from, a corresponding driving roller among the plurality of driving rollers, independently from the pair of side pinch rollers;

a holding member that is held by the first holding shaft and holds the at least one center pinch roller such that the at least one center pinch roller is rotatable; and a cam that is held by the second holding shaft and is allowed to contact the holding member;

the first holding shaft is fit into a recessed portion provided in the holding member;

the cam and the holding member contact, or are separated from, each other to cause the at least one center pinch roller to approach, or to be separated from, a corresponding driving roller among the plurality of driving rollers, independently from the pair of side pinch rollers; and the at least one center pinch roller is movable, from a state in which the pair of side pinch rollers and the at least one center pinch roller hold the recording medium together with the plurality of driving rollers, in such a direction as to be separated from the recording medium, independently from the pair of side pinch rollers, in a state in which the first holding shaft is not rotating.

* * * * *